US008480068B2

(12) United States Patent
Fujio et al.

(10) Patent No.: US 8,480,068 B2
(45) Date of Patent: Jul. 9, 2013

(54) NEWSPAPER PRODUCTION APPARATUS

(75) Inventors: Noboru Fujio, Hamura (JP); Hiroki Sezaki, Zama (JP); Hisashi Goto, Ebina (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 170 days.

(21) Appl. No.: 12/958,652

(22) Filed: Dec. 2, 2010

(65) Prior Publication Data

US 2011/0187802 A1 Aug. 4, 2011

(30) Foreign Application Priority Data

Jan. 29, 2010 (JP) ..... 2010-019286

(51) Int. Cl.
*B41F 13/56* (2006.01)

(52) U.S. Cl.
USPC ..... 270/5.03; 270/4; 270/5.02; 270/20.1; 270/21.1; 270/52.07

(58) Field of Classification Search
USPC ..... 270/4, 5.01, 5.02, 5.03, 18, 20.1, 270/21.1, 52.07
See application file for complete search history.

(56) References Cited

U.S. PATENT DOCUMENTS

| | | | | |
|---|---|---|---|---|
| 5,653,429 | A * | 8/1997 | Michalik et al. | 270/8 |
| 6,821,038 | B2 * | 11/2004 | Izawa | 400/621.1 |
| 7,631,857 | B2 * | 12/2009 | Hunkeler et al. | 270/5.03 |
| 7,661,359 | B2 * | 2/2010 | Eckert | 101/227 |
| 7,765,925 | B2 * | 8/2010 | Eckert et al. | 101/227 |
| 2003/0219297 | A1 | 11/2003 | Izawa | |
| 2004/0075208 | A1 * | 4/2004 | Takahashi et al. | 270/32 |
| 2004/0084825 | A1 * | 5/2004 | Teshima et al. | 270/42 |
| 2004/0221749 | A1 * | 11/2004 | Fujinuma et al. | 100/327 |
| 2008/0136081 | A1 * | 6/2008 | Richards | 270/18 |
| 2008/0156209 | A1 * | 7/2008 | Eckert | 101/226 |
| 2008/0257182 | A1 * | 10/2008 | Eckert et al. | 101/227 |
| 2009/0064880 | A1 * | 3/2009 | Eckert et al. | 101/220 |

FOREIGN PATENT DOCUMENTS

| | | | |
|---|---|---|---|
| DE | 10 2009 039 278 | A1 | 6/2011 |
| DE | 10 2010 003 363 | A1 | 9/2011 |
| EP | 1318096 | A2 | 6/2003 |
| JP | 62-105983 | | 7/1987 |
| JP | 01-192668 | | 8/1989 |
| JP | 08-230148 | | 9/1996 |

(Continued)

OTHER PUBLICATIONS

Search Report dated Oct. 22, 2012 which issued in connection with the corresponding Dutch application.

*Primary Examiner* — Leslie A Nicholson, III
(74) *Attorney, Agent, or Firm* — Clark Hill PLC

(57) ABSTRACT

Provided is a newspaper production apparatus which can make the processing mechanisms after digital printing small-scaled and which can quite easily obtain a favorably stacked state of sheets. The newspaper production apparatus includes: a paper feeding unit which feeds a continuous paper; ink jet printing units; and a folding unit which cuts and folds the continuous paper after being printed. The folding unit is configured as a rotary folding unit provided with a folding cylinder including: a retaining mechanism which retains a sheet on an outer circumferential surface of the folding cylinder; and a folding blade mechanism which projects the retained sheet radially outward. The rotary folding unit is capable of collect run by which sheets retained by the retaining mechanism are folded at each plural number of turns of the folding cylinder.

3 Claims, 12 Drawing Sheets

FOREIGN PATENT DOCUMENTS

| | | |
|---|---|---|
| JP | 11-333787 | 12/1999 |
| JP | 2002-193545 | 7/2002 |
| JP | 2003-171063 | 6/2003 |
| JP | 2003-281513 | 10/2003 |
| JP | 2003-341927 | 12/2003 |
| JP | 2006-281513 | 10/2006 |
| JP | 2007-015859 | 1/2007 |
| JP | 2007-076923 | 3/2007 |
| JP | 2009-226584 | 10/2009 |
| JP | 2010-540424 | 6/2010 |
| WO | 2009/118915 | 10/2009 |
| WO | 2010/061695 A1 | 6/2010 |

* cited by examiner

NEWSPAPER PRODUCTION APPARATUS

CROSS-REFERENCE TO RELATED APPLICATION

The present application relates to subject matter contained in Japanese Patent Application No. 2010-019286, filed on Jan. 29, 2010, all of which are expressly incorporated herein by reference in their entirety.

BACKGROUND OF THE INVENTION

1. Field of the Invention

The present invention relates to a newspaper production apparatus which produces a newspaper by performing ink jet printing on a continuous paper and cutting and folding the continuous paper.

2. Description of the Related Art

Newspaper as a representative medium of mass communication has played its role through large circulation of many pages on which contents covering various fields including politics, economy, literature, sports, hobby, entertainment, etc. are printed. Recently, however, instead of large circulation of many pages, there has been an increasing demand for newspapers that match particular tastes of readers, such as a newspaper focusing on topics field by field, a newspaper targeting readers of a limited district, generation, occupation, etc., a newspaper having characters of both of them, etc. Then, as a newspaper producing means to deal with this demand, newspaper production apparatuses relying on digital printing such as ink jet printing which does not use a press plate are proposed by Patent Documents 1 to 4 identified below.

Newspaper production disclosed in Patent Document 1 includes (1) a receiving element such as a grasping device, a sucker, etc. receiving sheet by sheet, from a conveyor, sheets of paper on which digital printing such as ink jet printing, etc. has been performed or sheets of paper cut out from a continuous paper on which digital printing has been performed, and carrying the sheets sequentially into a collecting station, (2) stacking the sheets one upon another on the collecting station, (3) discharging a stack of a certain number of sheets from the collecting station, (4) continuously carrying a subsequent series of printed sheets one by one into the collecting station from which the stack has been discharged, (5) carrying the stack discharged from the collecting station into a folding station, and (6) folding the stack in the folding station and outputting the stack from the folding station. The steps (1) to (6) are performed sequentially by the respective stations.

Newspaper production disclosed in Patent Document 2 is approximately the same as that disclosed in Patent Document 1. To be specific, Patent Document 2 is different from Patent Document 1 in disclosing that after a printed continuous paper is dried, it is divided into two pieces in parallel with the direction of continuation, and in disclosing as to the steps (1) and (2) that a delivery fan mechanism which rotates intermittently is provided in the collecting station, and sheets of paper cut out from a continuous paper on which digital printing has been performed are discharged toward the blades of the delivery fan maintained horizontally so that the sheets are stacked, or that sheets of paper cut out from a continuous paper on which digital printing has been performed are sequentially inserted into between respective blades of a continuously rotating delivery fan having many blades arranged in a circumferential direction, and then a baffle plate lets the sheets of paper fall from between the blades onto a conveyor so that the sheets are stacked.

Newspaper production disclosed in Patent Document 3 includes, in an order from an upstream side: a digital printing system which prints on a continuous paper; a side edge cutting station which cuts unnecessary side edge portions of the continuous paper; a lengthwise direction cutting station which cuts the continuous paper in its lengthwise direction (in parallel with the direction of continuation); a widthwise cutting station which cuts the continuous paper widthwise (orthogonally to the direction of continuation) to separate it into sheets of paper; a removing device which removes faulty sheets including a poorly printed portion or a damaged portion, etc. from the separated sheets on the process path; a collecting station on which the sheets of paper are stacked; a carrying device which carries the stack of sheets stacked on the collecting station to a widthwise folding station; a widthwise folding station which folds the stack carried by the carrying device in a direction transverse to the carrying direction; a lengthwise direction folding station which folds the stack in the carrying direction; a sewing station which sews the folded stack along the folding edge; a second collecting station into which a signature formed by folding the stack or by folding and sewing the stack is inserted one into another; and a delivery station which delivers a completed newspaper. By bringing any stations that are unnecessary according to the configuration and format of the newspapers to be made into a non-operative condition, it is possible to produce various types of newspapers that are different from one another in the configuration and format, without interrupting the continuous producing process.

By indicating the publication number of a European Patent, Patent Document 3 suggests, as the collecting station, a rotary cylinder mechanism which is provided with plural pairs of claws arranged in parallel with its shaft center and which allows sheets of paper to be stacked on its outer circumferential surface by the two claws of each pair alternately sandwiching and retaining a sheet between themselves and the outer circumferential surface. Likewise, by indicating the publication number of a European Patent, Patent Document 3 suggests, as either or both of the widthwise folding station and the lengthwise direction folding station, a mechanism which includes at least: a feed surface; a pair of initial folding rollers parallel with the feed surface and having axes parallel with each other; at least one pair of moving rollers having axes orthogonal to the feed surface and provided above the initial folding rollers; and a rectilinear knife which is a folding blade provided in parallel with the axes of the initial folding rollers. This mechanism feeds a stack of sheets, which are horizontally put and fed to the feed surface, into between the pair of initial folding rollers by causing the rectilinear knife to project upward a portion of the stack at which the stack is to be folded, then causes the two initial folding rollers to rotate about their axes while sandwiching therebetween the projected stack of sheets to form an incomplete folding line and at the same time send forth the stack to the at least one pair of moving rollers provided above, and then causes the at least one pair of moving rollers to rotate while sandwiching therebetween the folding line to form a complete folding line and at the same time send forth the stack of sheets in parallel with the axes of the initial folding rollers.

When producing a newspaper of a blanket size, newspaper production disclosed in Patent Document 4 defines a blanket-size newspaper such that the widthwise direction of a continuous paper and the horizontal direction of the blanket-size newspaper are parallel, sends forth to the downstream side the continuous paper on which each predetermined number of pages are printed repeatedly in the lengthwise direction of the continuous paper by a digital printing device with two pages of the newspaper arranged in the widthwise direction of the continuous paper and at the same time cuts the continuous paper in parallel with the widthwise direction at lengths equal to the vertical dimension of the blanket-size newspaper, scores the cut sheets at their widthwise center, stacks the scored sheets by making the sheets sequentially straddle a collation chain such that their scored folding line aligns with the spine of the collation chain, folds the sheets into two by causing a discharging member to project the folding line of the plurality of sheets straddling the collation chain while being stacked into between carrying conveyors facing each other, and guides the twofold sheets to a quarter folding mechanism, which then produces the sheets into a fourfold blanket-size newspaper. When producing a newspaper of a tabloid size which is half the blanket size, newspaper production disclosed in Patent Document 4 defines a newspaper of a tabloid size half the blanket size such that the widthwise direction of a continuous paper and the vertical direction of the tabloid-size newspaper are parallel, sends forth to the downstream side the continuous paper on which each predetermined number of pages are printed repeatedly in the lengthwise direction of the continuous paper by the digital printing device with two pages of the newspaper arranged in the widthwise direction of the continuous paper and at the same time cuts the continuous paper in parallel with the widthwise direction at lengths double the horizontal dimension of the tabloid-size newspaper, scores the cut sheets at their widthwise center, stacks the scored sheets by making the sheets sequentially straddle the collation chain such that their scored folding line aligns with the spine of the collation chain, folds the sheets into two by causing the discharging member to project the folding line of the plurality of sheets straddling the collation chain while being stacked into between the carrying conveyors facing each other, guides the twofold sheets to a cutting/sewing station, cuts the twofold sheets at the vicinity of the scored folding line along the folding line to produce them into a stack of cut sheets in each of which there are arranged two pages of the tabloid-size newspaper of which horizontal direction is parallel with the cutting edge, and if necessary, sews the stack at its center in the direction in which the two pages of the tabloid-size newspaper are arranged such that the stack is sewn along a direction orthogonal to the cutting edge, and guides the stack to the quarter folding mechanism, which quarter-folds the stack along the sewing position to produce it into a twofold tabloid-size newspaper.

[Patent Document 1] JP2002-193545A
[Patent Document 2] JP2003-341927A
[Patent Document 3] JP2007-15859A
[Patent Document 4] JP2007-76923A

SUMMARY OF THE INVENTION

Like done in an after-treatment following printing of a conventional digital print product, such a newspaper production apparatus as represented by Patent Documents 1 to 4 identified above which is based on a digital printing manner proposed so far cuts a continuous paper on which printing has been performed into individual sheets, carries them, collects and stacks them in their original flat-sheet state or after giving them a first fold, and guides them to a quarter folding mechanism to quarter-fold them, thereby producing newspaper signatures. This requires an unprecedentedly large process space for carrying, stacking, and folding printed sheets of a newspaper, which has an area by far larger than that of conventional digital print products. The processing mechanisms following the printing device inevitably become large-scaled, which is out of balance with the printing device having a simple structure and requires an extra installation area.

Meanwhile, paper for newspaper production is relatively thin and elasticity-lacking among papers used for printing. Therefore, when carrying the paper, it is necessary to restrict any moves of the edges of the paper across approximately the entire width so that the edges do not become recurvate or bent due to air resistance, and it is also necessary to strictly finish the manufacture and assembly of any members that contact the paper so that the paper is not wrinkled or torn due to any unnecessary force that might act on the paper when the carrying force becomes imbalanced. Furthermore, when stacking, it is quite difficult to stack the sheets in a way to make the four sides meet their corresponding sides, because a whole sheet does not move uniformly because the sheet warps halfway or cannot resist the contact friction between sheets even if the side edges of the sheets are hit either or both of during free fall and after fall.

The present invention was made in view of the above problems of the conventional techniques, and an object of the present invention is to provide a newspaper production apparatus which can make the processing mechanisms after digital printing small-scaled and which can quite easily obtain a favorably stacked state of sheets.

The present invention aims for accomplishing the above object by the configuration described in the claims. A newspaper production apparatus according to the present invention is a newspaper production apparatus, including: a paper feeding unit which feeds a continuous paper; an ink jet printing unit; and a folding unit which cuts and folds the continuous paper having been printed. The folding unit is a rotary folding unit provided with a folding cylinder including: a retaining mechanism which retains a sheet on an outer circumferential surface of the folding cylinder; and a folding blade mechanism which projects the retained sheet radially outward.

In the newspaper production apparatus according to the present invention, the rotary folding unit may be capable of collect run by which sheets retained by the retaining mechanism are folded at each plural number of turns of the folding cylinder.

In the newspaper production apparatus according to the present invention, a slitter mechanism and an overlaying mechanism may be provided downstream of the ink jet printing unit. The slitter mechanism cuts the continuous paper along its direction of continuation, and the overlaying mechanism overlays the cut continuous papers.

In the newspaper production apparatus according to the present invention, the slitter mechanism and the overlaying mechanism may be provided on the folding unit.

The newspaper production apparatus according to the present invention may be provided with a rotary folding unit including a folding cylinder at the downstream of a digital printing unit. Therefore, the processing mechanisms in the newspaper production apparatus that are downstream of digital printing can become remarkably small-scaled compared with conventional ones, and this enables the installation area of the entire newspaper production apparatus to be the requisite minimum. Further, since sheets are overlaid together by being wound around the outer circumferential surface of the folding cylinder, a favorably stacked state of sheets can be obtained quite easily.

DETAILED DESCRIPTION OF THE INVENTION

Preferred embodiments for carrying out the present invention will now be explained with reference to the drawings. The following embodiments are not intended to limit the inventions set forth in the claims, and all the combinations of features explained in the embodiments are not necessarily indispensable for the means for solving provided by the invention.

First Embodiment

Figure 1:
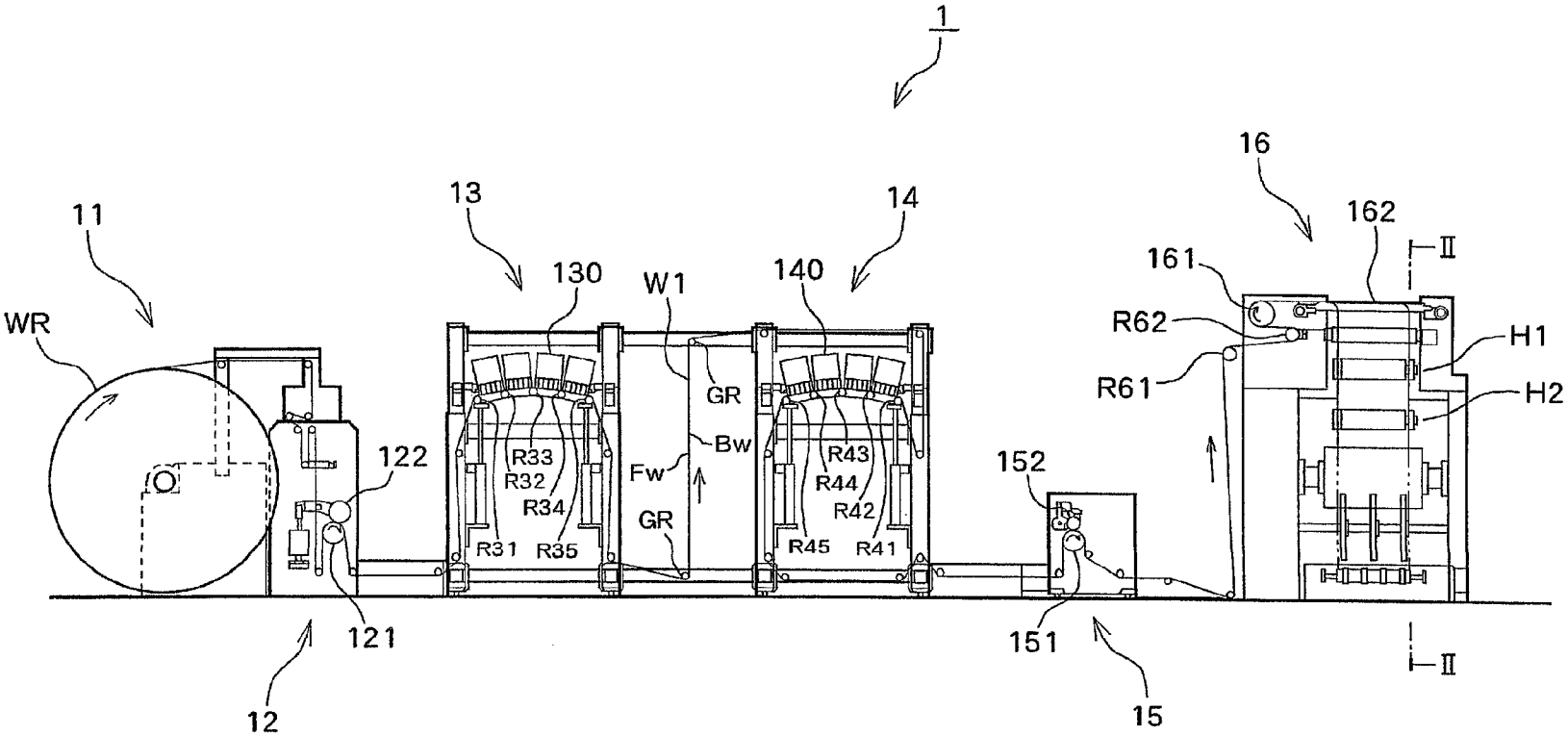
FIG. 1 is a front inner diagram showing a newspaper production apparatus according to a first embodiment.
Figure 2:
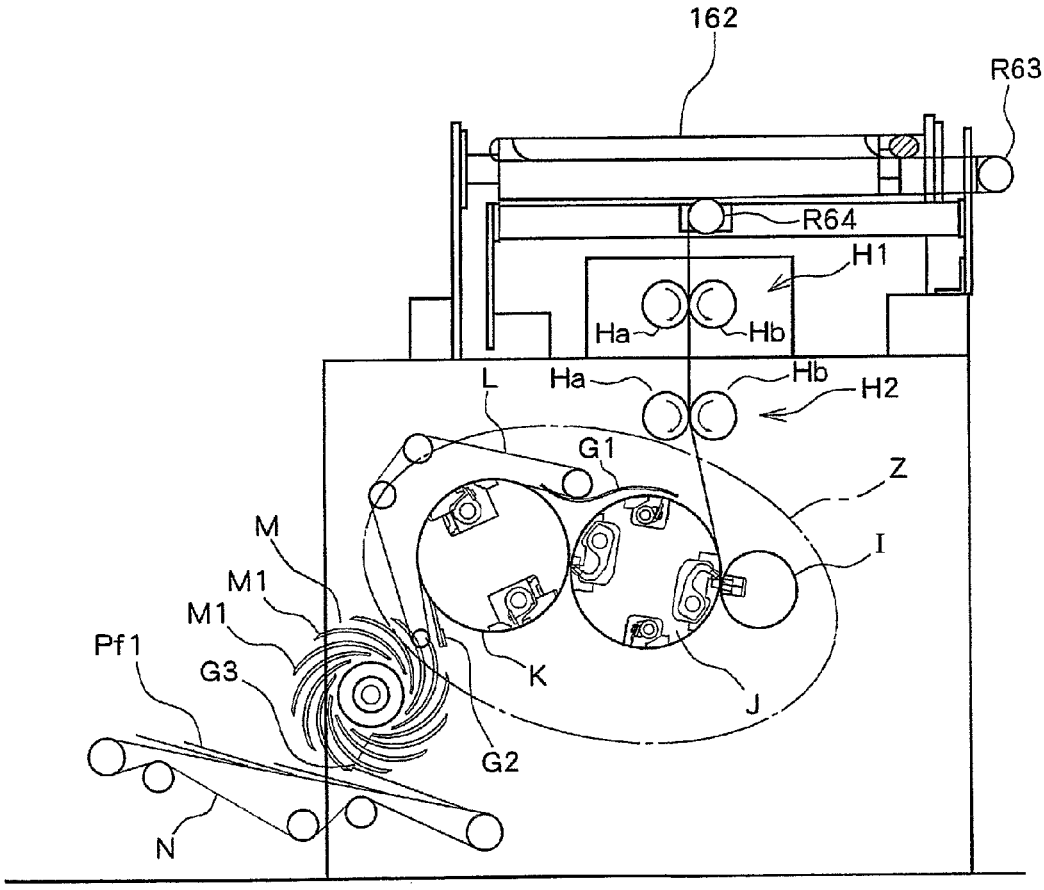
FIG. 2 is a sectional diagram of FIG. 1 taken at a position of II-II and seen with the sightline directed to the direction of arrows, and is an inner diagram of a folding unit.

FIG. 1 is a front inner diagram showing a newspaper production apparatus according to a first embodiment. FIG. 2 is a sectional diagram of FIG. 1 taken at the position of II-II and seen with the sight line directed to the direction of arrows, and is an inner diagram of a folding unit 16. A drive source for rotating bodies which are rotatably driven and a belt which moves while being wound around a rotating body, etc. is not shown. Arrows indicate the rotating directions of the rotating bodies and the progressing direction of the belt and paper when printing is performed.

The newspaper production apparatus 1 includes, from the left-hand side of FIG. 1, a paper feeding unit 11, an in-feed unit 12, two ink jet printing units 13 and 14, an out-feed unit 15, and a folding unit 16, and a plurality of guide rollers GR which are disposed at appropriate positions for guiding a continuous paper.

The paper feeding unit 11 has a paper roll WR suspended therefrom, and feeds a continuous paper W1 from the paper roll WR.

The in-feed unit 12 sends forth the continuous paper W1 to the following ink jet printing unit 13 by tensioning the continuous paper W1 by means of an in-feed roller 121 which is rotatably driven and a trolley 122 which presses the continuous paper W1 wrapped around the in-feed roller 121 onto the circumferential surface of the in-feed roller 121.

The first ink jet printing unit 13 includes an ink jet head unit 130 configured by a plurality of ink jet heads, and prints on a front surface Fw of the continuous paper W1 by the printing paper W1 running from left to right in FIG. 1 by being guided by guide rollers R31 to R35.

The continuous paper W1 of which front surface Fw has been printed by the first ink jet printing unit 13 is guided by the guide roller GR to be introduced to the second ink jet printing unit 14.

The second ink jet printing unit 14 also includes an ink jet head unit 140 configured by a plurality of ink jet heads, and prints on a back surface Bw of the continuous paper W1 by the continuous paper W1 running from right to left in FIG. 1 by being guided by guide rollers R41 to R45.

The out-feed unit 15 tensions the continuous paper W1 running through the ink jet printing units 13 and 14 in cooperation with the in-feed unit 12, by means of an out-feed roller 151 which is rotatably driven and a trolley 152 which presses the continuous paper W1 wrapped around the out-feed roller 151 onto the circumferential surface of the out-feed roller 151, and also sends forth the continuous paper W1 to the following folding unit 16.

The folding unit 16 includes a paper drawing roller 161, an angle bar 162, two pairs of nipping rollers H1 and H2, a cutting cylinder I, a folding cylinder J, a jaw cylinder K, a guide belt L, a delivery fan M, a conveyor N, paper guides G1, G2, and G3, and guide rollers R61 to R64.

To be specific, the continuous paper W1 which has been printed is wound by the guide rollers R61 and R62 around the paper drawing roller 161 rotatably driven, and drawn and guided to the top of the folding unit 16. After this, the continuous paper W1 is reoriented by 90 degrees horizontally by the angle bar 162, and guided to the nipping rollers H1 by the guide rollers R63 and R64.

The nipping rollers H1 and H2 are positioned below the guide roller R63 and with the former above the latter, and each pair comprises a pair of laterally arranged rollers Ha and Hb which are rotatably driven in directions opposite to each other. The rollers Ha and Hb have pressing portions, which are formed near widthwise both edges of the continuous paper W1 passing therebetween, and which have a larger size than the remaining portion. The continuous paper W1 is sent forth from the lower nipping rollers H2 to between the folding cylinder J and the cutting cylinder I, with its portions near the widthwise both edges pressed with an appropriate pressing force by the pressing portions of the rollers Ha and Hb of the nipping rollers H1 and H2.

The cutting cylinder I and the folding cylinder J are positioned side by side laterally with the shaft center of the folding cylinder J slightly higher than the shaft center of the cutting cylinder I and with a slight gap secured between their circumferential surfaces. The folding cylinder J and the cutting cylinder I are rotatably driven in directions opposite to each other, and positioned such that the continuous paper W1 to be sent forth from the nipping rollers H2 to between the folding cylinder J and the cutting cylinder I enters therebetween approximately along the direction of a tangent line of the folding cylinder J.

The jaw cylinder K is positioned to adjoin the folding cylinder J at a side opposite to the cutting cylinder I, with the shaft center of the jaw cylinder K slightly higher than the shaft center of the folding cylinder J and with a slight gap secured between their circumferential surfaces. The jaw cylinder K is rotatably driven in a direction opposite to the folding cylinder J.

Figure 3A:
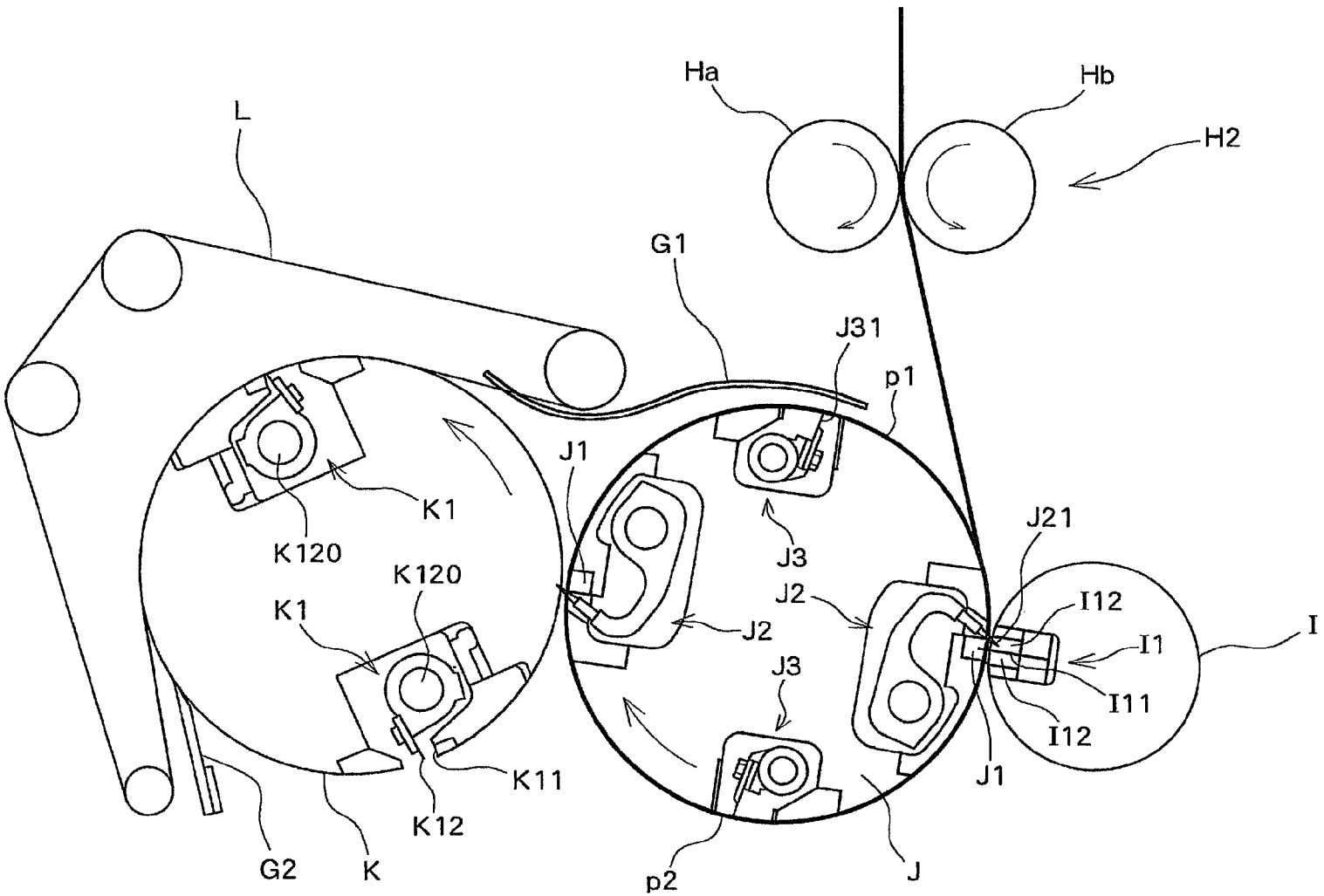
FIG. 3A is an enlarged diagram of a portion Z of FIG. 2, and is a schematic sectional diagram of a cutting cylinder, a folding cylinder, and a jaw cylinder, showing a position of a cutting blade device where it faces a cutting blade receiver.
Figure 3B:
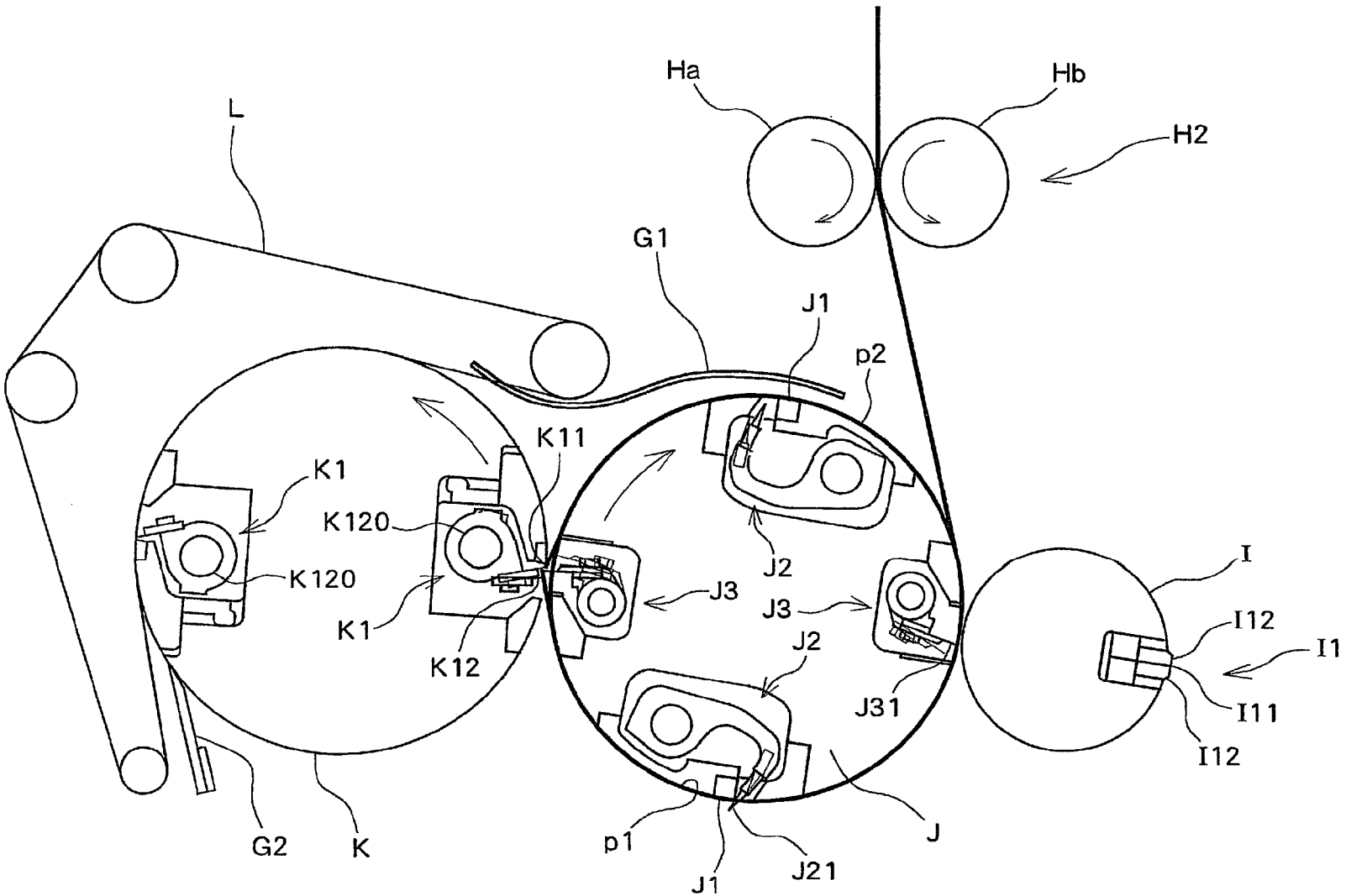
FIG. 3B is an enlarged diagram of a portion Z of FIG. 2, and is a schematic sectional diagram of a cutting cylinder, a folding cylinder, and a jaw cylinder, showing a position of a folding blade device where it faces a jaw device.

FIG. 3A and FIG. 3B are enlarged diagrams of a portion Z of FIG. 2, and are schematic sectional diagrams of the cutting cylinder I, the folding cylinder J, and the jaw cylinder K.

The cutting cylinder I includes one cutting blade device I1. The cutting blade device I1 comprises a cutting blade I11 and a cheek wood I12. The cutting blade I11 is saw-toothed with the blade edge shaped into fine chevron waves, and the blade edge projects radially outward from the circumferential surface of the cutting cylinder I in a direction parallel with the axis thereof. The cheek wood I12 is an elastic body provided on both sides of the cutting blade I11 to abut on the cutting blade I11 all along. When a cutting blade receiver J1 described later which is provided in the folding cylinder J comes at a position at which it faces the cheek wood I12 along with the rotation of the cylinder, the elasticity of the cheek wood I12 causes the continuous paper W1 to be sandwiched between the cutting blade receiver J1 and the cheek wood I12, and the blade edge of the cutting blade I11 eats into the cutting blade receiver J1 by 1 to 2 millimeters, thereby cutting the continuous paper W1 in parallel with the widthwise direction. The length (cutting length) at which the continuous paper W1 is cut by the cutting cylinder I at each full turn is the horizontal length of two pages of a newspaper to be made by the present newspaper production apparatus described later.

The folding cylinder J has a circumferential length double the cutting length of the continuous paper W1, and is provided near the circumferential surface thereof at uniform intervals with two cutting blade receivers 31, two pin devices J2 as retaining mechanisms for retaining a sheet (the continuous paper W1 or a sheet cut out from the continuous paper W1; the same applies hereinafter) on the circumferential surface of the folding cylinder J, and two folding blade devices J3 as folding blade mechanisms for projecting radially outward the sheet retained on the circumferential surface of the folding cylinder J.

The cutting blade receivers J1 are made of rubber having an appropriate hardness, and cut the continuous paper W1 by facing the cutting blade device I1 of the cutting cylinder I and sandwiching the continuous paper W1 between themselves and the cutting blade device I1.

When considered in the rotational direction of the folding cylinder J, the pin devices J2 are located immediately after the position at which the cutting blade I11 of the cutting blade device I1 cuts the continuous paper W1 in cooperation with the cutting blade receiver 31. One pin device J2 has some pins J21, which can be projected and retracted from the circumferential surface of the folding cylinder J and which are provided at appropriate intervals in the widthwise direction of the continuous paper W1. Along with the rotation of the folding cylinder J, the pins J21, which are being projected from the circumferential surface of the folding cylinder J by several millimeters, begin sticking into the continuous paper W1 immediately before the continuous paper W1 is cut by the cutting blade I11, retain the cut continuous paper W1 by sticking into the leading edge portion of the continuous paper W1, and draw the continuous paper W1 to have it taken up around the folding cylinder J. Then, at an appropriate timing, the pins J21 are retracted from the circumferential surface of the folding cylinder J to be pulled out from the sheet taken up and retained on the folding cylinder J, so as not to hinder the sheet from being passed over to the jaw cylinder K. The jaw cylinder K has a runout groove to prevent interference by the pins J21, and the cheek wood I12 of the cutting cylinder I has a hardness that allows the pins J21 to stick thereinto easily.

The folding blade devices J3 have a folding blade J31, which is a thin plate that can be projected and retracted from the circumferential surface of the folding cylinder J in the widthwise direction of the continuous paper W1. The folding blade J31 is provided to project to a middle position between positions at which the continuous paper W1 is cut (there are two such positions on the circumferential surface of the folding cylinder J). By projecting from the circumferential surface of the folding cylinder J at an appropriate timing, the folding blade J31 inserts the sheet taken up around the folding cylinder J by the pins J21 into between jaw plates K11 and K12 of a jaw device K1 described later which is provided in the jaw cylinder K.

Next, the jaw cylinder K has a circumferential length double the cutting length, and is provided near the circumferential surface thereof at uniform intervals with two jaw devices K1.

The jaw devices K1 each have two closely provided jaw plates K11 and K12. The jaw plate K11 is attached and fixed on the jaw cylinder K, while the jaw plate K12 can swing about a swing shaft K120 such that its edge can contact and separate from the edge of the jaw plate K11 at the circumferential surface of the jaw cylinder K. Then, when, along with the rotation of the jaw cylinder K, a portion between the edge of the jaw plate K11 and the edge of the jaw plate K12 comes to face the folding blade J31 of the folding cylinder J with these edges separated, the folding blade J31 projects and thereby inserts the sheet having been taken up around the circumferential surface of the folding cylinder J into between the jaw plates K11 and K12, and immediately after this, the jaw plate K12 swings in the direction to bring its edge to contact the edge of the jaw plate K11, so that the edge of the jaw plate K11 and the edge of the jaw plate K12 sandwich and grip therebetween the sheet inserted by the folding blade J31.

The sheet gripped by the edge of the jaw plate K11 and the edge of the jaw plate K12 is given a folding line at the gripped position, and has its leading edge portion, which has been taken up around the folding cylinder J, released from the folding cylinder J by the pins J21 of the folding cylinder J being retracted, and attracted toward the jaw cylinder K from the folding cylinder J along the paper guide G1, with the trailing portion following the gripped position taken up around the jaw cylinder K.

The guide belt L is an endless belt, which is guided by a plurality of pulleys including rotatably driven pulleys, and a part of which is wound around the jaw cylinder K. The guide belt L sandwiches between itself and the circumferential surface of the jaw cylinder K the sheet that comes taken up around the jaw cylinder K as headed by the folding line formed by the jaw plates K11 and K12, thereby overlaying a half and another half of the folded sheet in a way to bring both the cutting edges to meet to produce a newspaper signature Pf1, and carries the newspaper signature Pf1 to above the delivery fan M in cooperation with the jaw cylinder K.

Before the gripped position of the newspaper signature Pf1 reaches an edge of the paper guide G2 by the jaw cylinder K making a turn slightly larger than a half turn from the position at which the folding blade J31 faces the portion between the jaw plates K11 and K12, the jaw plate K12 swings in a direction to separate its edge from the edge of the jaw plate K11 to release the newspaper signature Pf1 from the jaw cylinder K.

The newspaper signature Pf1 released from the jaw cylinder K is guided to between a blade M1 and a blade M1 of the delivery fan M by the paper guide G2 and a portion of the guide belt L that progresses having come out of contact with the circumferential surface of the jaw cylinder K.

The delivery fan M is rotatably driven to move by what corresponds to the interval between a blade M1 and a blade M1 while the jaw cylinder K is making a half turn, and decelerates newspaper signatures Pf1 carried thereto at the same speed as the running speed of the continuous paper W1 by receiving them one by one between a blade M1 and a blade M1. When a newspaper signature Pf1 received between the blade M1 and the blade M1 is carried to the bottom of the delivery fan M, it is pushed out from between the blade M1 and the blade M1 by the paper guide G3 onto the conveyor N driven at a lower speed than the running speed of the continuous paper W1 to be discharged in a squamiform arrangement in which the newspaper signatures Pf1 partially overlap each other.

The newspaper signatures Pf1 discharged by the conveyor N are shaped into a desired style of packing by an unillustrated after-treatment device.

The folding cylinder J and the jaw cylinder K have the same rotating speed, and the cutting cylinder I rotates at double the rotation speed of the folding cylinder J and the jaw cylinder K. They are driven to synchronize the cutting blade device I1 of the cutting cylinder I with the cutting blade receiver J1 of the folding cylinder J and the folding blade J31 of the folding cylinder J with the portion between the jaw plates K11 and K12 of the jaw cylinder K such that they face each other along with rotation as described above.

The newspaper production apparatus 1 shown in FIG. 1 is configured such that in the running path of the continuous paper W1, the angle bar 162 of the folding unit 16 changes the running direction of the continuous paper W1 by 90 degrees horizontally, so that the newspaper signatures Pf1 are discharged from the conveyor N in a direction orthogonal to the running direction of the continuous paper W1 running through the newspaper production apparatus 1. However, the angle bar may be removed from the configuration to produce the newspaper signatures Pf1 be discharged from the conveyor N in the same direction as the running direction of the continuous paper W1 running through the newspaper production apparatus 1.

Next, a process of producing a newspaper including eight pages and written vertically with the use of the newspaper production apparatus 1 will be explained.

Figure 4:
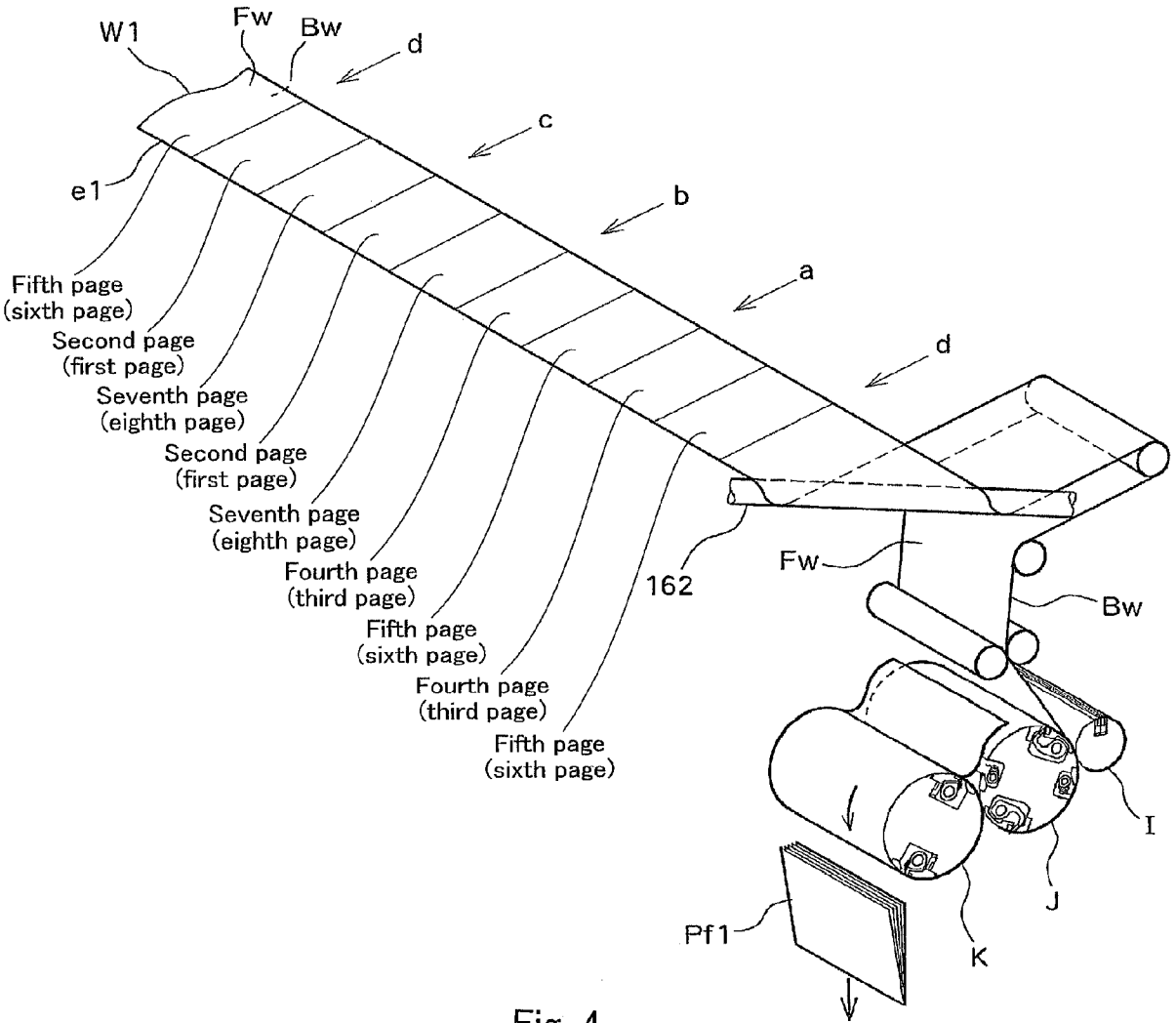
FIG. 4 is a perspective diagram exemplarily showing in a simplified form a path through which a printed continuous paper becomes newspaper signatures.
Figure 5:
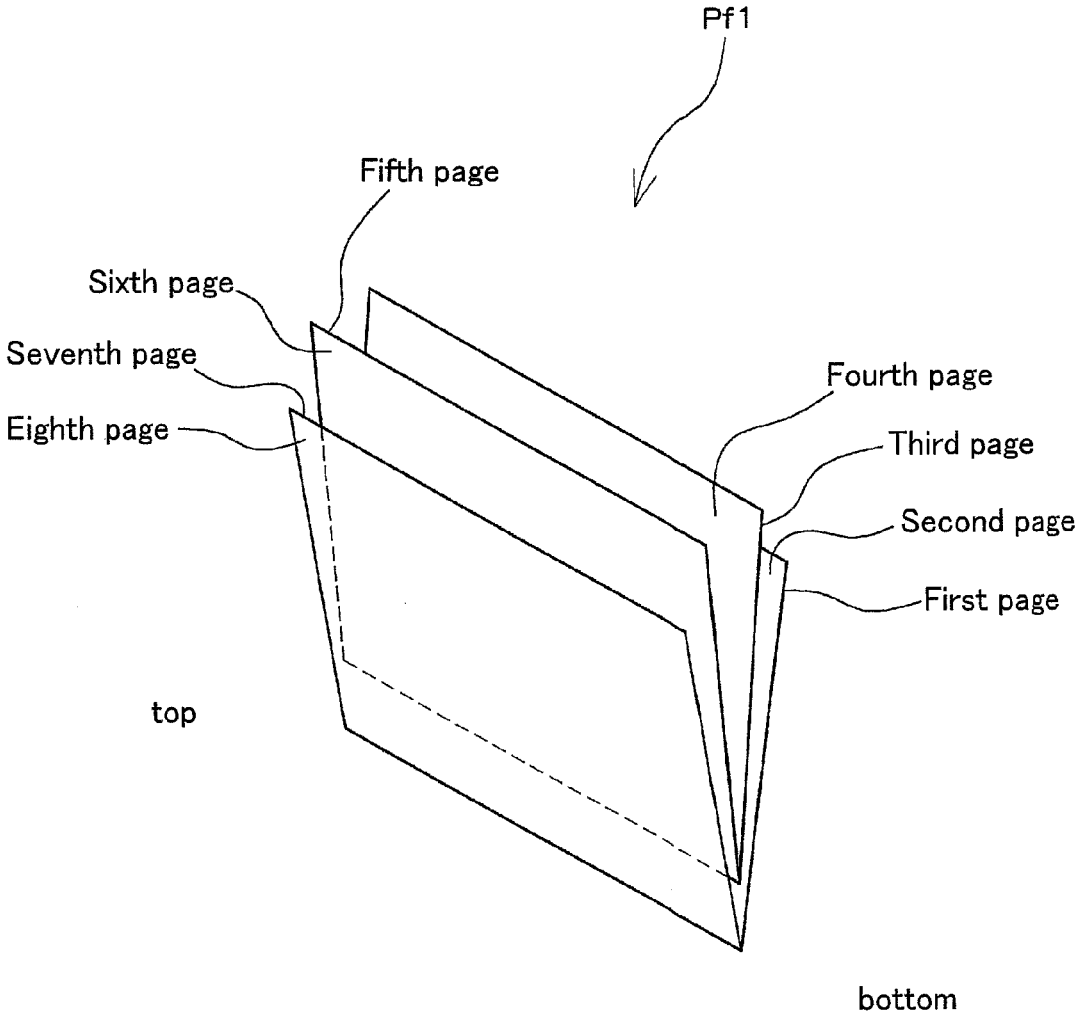
FIG. 5 is a perspective diagram showing a newspaper signature in an incompletely overlaid state, in order to show the page configuration of the newspaper signature in an easy-to-understand manner.

FIG. 4 is a perspective diagram exemplarily showing in a simplified form a path through which the continuous paper W1 having been printed becomes newspaper signatures Pf1. FIG. 5 is a perspective diagram showing a newspaper signature Pf1 of FIG. 4 in an incompletely overlaid state, in order to show the page configuration of the newspaper signature Pf1 in an easy-to-understand manner.

The width of the continuous paper W1 is the same as the vertical length of the newspaper to be made. In FIG. 4, an edge e1 of the continuous paper W1 (i.e., the viewer side, in FIG. 1, of the continuous paper W1 running through the ink jet printing units 13 and 14, in the configuration of the newspaper production apparatus 1 shown in FIG. 1) is the top edge of the newspaper pages.

The continuous paper W1 passed from the paper feeding unit 11 into the first ink jet printing unit 13 through the in-feed unit 12 has its front surface Fw printed firstly with the content of a fifth page and secondly with the content of a fourth page. Thirdly, the front surface Fw is printed with the content of the fifth page again and fourthly with the content of the fourth page. Subsequently, the front surface Fw is printed fifthly with the content of a seventh page and sixthly with the content of a second page. Then, the front surface Fw is printed seventhly with the content of the seventh page again, and eighthly with the content of the second page. That is, the contents are printed repeatedly in the order of the fifth page, the fourth page, the fifth page, the fourth page, the seventh page, the second page, the seventh page, and the second page. The continuous paper W1 having had its front surface Fw printed in this way has its back surface Bw behind the content of the fifth page printed with the content of a sixth page and its back surface Bw behind the content of the fourth page printed with the content of a third page repeatedly, and then has its back surface Bw behind the content of the seventh page printed with the content of an eighth page and its back surface Bw behind the content of the second page printed with the content of a first page repeatedly by the second ink jet printing unit 14. That is, the contents are printed repeatedly in the order of the sixth page, the third page, the sixth page, the third page, the eighth page, the first page, the eighth page, and the first page (the pages parenthesized in FIG. 4) by performing positional matching with the contents printed on the front surface Fw.

The continuous paper W1 having had its front and back surfaces both printed is guided to the folding unit 16 through the out-feed unit 15. The continuous paper W1 drawn to the top of the folding unit 16 by the paper drawing roller 161 is reoriented by 90 degrees horizontally by the angle bar 162 and guided to the nipping rollers H1 by the guide rollers R63 and R64. The rollers Ha and Hb of the nipping rollers H1 sandwich the widthwise both edges of the continuous paper W1, i.e., the top and bottom margins of the page with an appropriate pressing force by the pressing portions, and send forth the continuous paper W1 to the nipping rollers H2. Like the nipping rollers H1, the nipping rollers H2 also sandwich the widthwise both edges of the continuous paper W1 with an appropriate pressing force by the pressing portions and send forth the continuous paper W1 to between the folding cylinder J and the cutting cylinder I. Since the continuous paper W1 is sent forth sandwiched by the two pairs of rotatably driven rollers Ha and Hb, a change in the tension of the continuous paper W1 due to the cutting performed between the following folding cylinder J and cutting cylinder I transmits no influence to the upstream side of the running path of the continuous paper W1. Further, since the rollers Ha and Hb sandwich the margins of the page, the ink on the page does not transfer to the pressing portions of the rollers Ha and Hb, preventing the page from being stained.

The continuous paper W1 sent forth from the nipping rollers H2 downward enters between the folding cylinder J and the cutting cylinder I. Along with the rotation of both the cylinders, the pins J21 projecting from the surface of the folding cylinder J come to stick into the continuous paper W from the front surface Fw to the back surface Bw while the cheek wood I12 comes to sandwich the continuous paper W1 between itself and the cutting blade receiver J1, allowing the cutting blade I11 to eat into the cutting blade receiver J1 to cut the continuous paper W1. By matching the printing timings of the ink jet printing units 12 and 13 and the rotation phases of the folding cylinder J and the cutting cylinder I, the positions to cut come between a fourth page printed on the front surface Fw and a fifth page printed after this (between a third page printed on the back surface Bw and a sixth page printed after this (the position indicated by an arrow a in FIG. 4)), between a fourth page printed on the front surface Fw and a seventh page printed after this (between a third page printed on the back surface Bw and an eighth page printed after this (the position indicated by an arrow b in FIG. 4)), between a second page printed on the front surface Fw and a seventh page printed after this (between a first page printed on the back surface Bw and an eighth page printed after this (the position indicated by an arrow c in FIG. 4)), and between a second page printed on the front surface Fw and a fifth page printed after this (between a first page printed on the back surface Bw and a sixth page printed after this (the positions indicated by arrows d in FIG. 4)) repeatedly in this order.

Since the continuous paper W1 is sandwiched between the cheek wood I12 and the cutting blade receiver J1, a wrong position will not be cut when the cutting blade I11 cuts the continuous paper W1 by eating into the cutting blade receiver J1.

The sheet resulting from the cutting is stuck by the pins J21 at its leading edge portion, and hence will be retained on the circumferential surface of the folding cylinder J until the pins J21 are retracted from the circumferential surface of the folding cylinder J and pulled out from the sheet.

In this way, a sheet having had its front surface Fw printed with the fifth and fourth pages and its back surface Bw printed with the sixth and third pages is generated firstly, a sheet having had its front surface Fw printed with the fifth and fourth pages and its back surface Bw printed with the sixth and third pages is again generated secondly, a sheet having had its front surface Fw printed with the seventh and second pages and its back surface Bw printed with the eighth and first pages is generated thirdly, and a sheet having had its front surface Fw printed with the seventh and second pages and its back surface Bw printed with the eighth and first pages is again generated fourthly, and this will be repeated.

When the first sheet p1 cut out from the continuous paper W1 is retained taken up around a half of the circumference of the folding cylinder J as drawn with its leading edge stuck by the pins J21, the folding blade J31 retracted from the circumferential surface of the folding cylinder J under the sheet p1 does not project even upon reaching the position at which it faces the portion between the jaw plates K11 and K12 of the jaw cylinder K, and the pins J21 sticking into the leading edge of the sheet p1 are not retracted, either. That is, remaining drawn and retained by the pins J21, the first sheet p1 goes to the position where its leading edge portion overlaps the running path of the continuous paper W1 again.

The portion of the continuous paper W1 to become the second sheet is also taken up around the circumferential surface of the folding cylinder J with its leading edge stuck by the pins J21.

The pins J21 drawing the first sheet p1 by retaining the leading edge portion by sticking thereinto further stick into the continuous paper W1 sent forth from the nipping rollers H2 along with the rotation of the folding cylinder J, while the cutting blade device I1 cuts the continuous paper W1 sandwiched between itself and the cutting blade receiver J1 to separate the trailing edge of the second sheet p2 from the leading edge of the portion of the continuous paper W1 to become the third sheet (see FIG. 3A). Then, the portion of the continuous paper W1 to become the third sheet is also taken up around the folding cylinder J as overlaid on the external surface of the first sheet p1 and drawn by the pins J21.

In the meantime, the second sheet p2 cut out from the continuous paper W1 goes rotating together with the folding cylinder J as drawn by the pins J21 and retained taken up around a half of the circumference of the folding cylinder J. Then, when the folding blade J31 retracted from the circumferential surface of the folding cylinder J under the sheet p2 reaches the position where it faces the portion between the jaw plates K11 and K12 of the jaw cylinder K, the folding blade J31 does not project, and the pins J21 sticking into the leading edge of the sheet p2 are not retracted, either. That is, remaining drawn by the pins J21, the second sheet p2 also goes to the position where its leading edge portion overlaps the running path of the continuous paper W1 again.

The pins J21 drawing the second sheet p2 by retaining the leading edge portion by sticking thereinto further stick into the continuous paper W1 sent forth from the nipping rollers H2 along with the rotation of the folding cylinder J, while the cutting blade device I1 cuts the continuous paper W1 sandwiched between itself and the cutting blade receiver J1 to separate the trailing edge of the third sheet from the leading edge of the portion of the continuous paper W1 to become the fourth sheet. Then, the portion of the continuous paper W1 to become the fourth sheet is also taken up around the folding cylinder J as overlaid on the external surface of the second sheet p2 and drawn by the pins J21.

Then, immediately before the folding blade J31 retracted from the circumferential surface of the folding cylinder J under the first sheet p1 and the third sheet overlaid together reaches the position where it faces the portion between the jaw plates K11 and K12 of the jaw cylinder K, the folding blade device J3 begins projecting the folding blade J31, and at approximately the same time as this, the pin device J2 sticking into the leading edge of the first sheet p1 and third sheet retracts the pins J21.

Immediately after the above actions, the folding blade J31 comes to face the portion between the jaw plates K11 and K12 of the jaw cylinder K and inserts the first sheet p1 and the third sheet into between the jaw plates K11 and K12. Immediately after the insertion, the jaw device K1 swings the jaw plate K12 about the swing shaft K120 to grip the first sheet p1 and the third sheet by the edge of the jaw plate K11 and the edge of the jaw plate K12, thereby attracting the leading half of the first sheet p1 and third sheet toward the jaw cylinder K from the folding cylinder J (see FIG. 3B), and having the trailing half of the first sheet p1 and third sheet taken up around the jaw cylinder K.

After inserting the first sheet p1 and the third sheet into between the jaw plates K11 and K12, the folding blade J31 is retracted into the folding cylinder J so as not to hinder the movement of the sheets that are attracted toward the jaw cylinder K from the folding cylinder J.

In this way, the two sheets resulting from the third sheet having been overlaid on the external surface of the first sheet p1 on the circumferential surface of the folding cylinder J have their center gripped by the edge of the jaw plate K11 and the edge of the jaw plate K12 to be given a folding line at the gripped position. Then, the sheets overlaid together and given a folding line have their half following the folding line overlaid on their half on the leading side when on the circumferential surface of the folding cylinder J, whereby the two sheets gripped by the edge of the jaw plate K11 and the edge of the jaw plate K12 go sandwiched between the jaw cylinder K and the guide belt L, to be formed into a newspaper signature Pf1 printed with the first to eighth pages. (See FIG. 5)

The newspaper signature Pf1 is carried to above the delivery fan M by the jaw cylinder K and the guide belt L. Before the gripped position of the newspaper signature Pf1 reaches the paper guide G2, the jaw device K1 swings the jaw plate K12 in a direction to separate its edge from the edge of the jaw plate K11 to release the newspaper signature Pf1 from the jaw plate K11 and the jaw plate K12 so that the newspaper signature Pf1 is thrown into between a blade M1 and a blade M1 of the delivery fan M by the paper guide G2 and a portion of the guide belt L that extends along the paper guide G2.

The newspaper signature Pf1 thrown into and received between a blade M1 and a blade M1 is discharged from between the blade M1 and the blade M1 onto the conveyor N, when the position in the delivery fan M in which it is received comes to the bottom as the delivery fan M rotates.

Meanwhile, the portion of the continuous paper W1 to become the fourth sheet is also taken up around the folding cylinder J as overlaid on the external surface of the second sheet p2 and drawn by the pins J21, while the cutting blade device I1 cuts the continuous paper W1 sandwiched between itself and the cutting blade receiver J1 to separate the trailing edge of the fourth sheet from the continuous paper W1. Then, immediately before the folding blade J31 retracted from the circumferential surface of the folding cylinder J under the second sheet p2 and the fourth sheet overlaid together reaches the position where it faces the portion between the jaw plates K11 and K12 of the jaw cylinder K, the folding blade device J3 begins projecting the folding blade J31, and at approximately the same time as this, the pin device J2 sticking into the leading edge of the second sheet p2 and fourth sheet retracts the pins J21.

Immediately after the above actions, the folding blade J31 comes to face the portion between the jaw plates K11 and K12 of the jaw cylinder K and inserts the second sheet p2 and the fourth sheet into between the jaw plates K11 and K12. Immediately after the insertion, the jaw device K1 swings the jaw plate K12 about the swing shaft K120 to grip the second sheet p2 and the fourth sheet by the edge of the jaw plate K11 and the edge of the jaw plate K12, thereby attracting the leading half of the second sheet p2 and fourth sheet toward the jaw cylinder K from the folding cylinder J and having the trailing half of the second sheet p2 and fourth sheet taken up around the jaw cylinder K.

After inserting the second sheet p2 and the fourth sheet into between the jaw plates K11 and K12, the folding blade J31 is retracted into the folding cylinder J so as not to hinder the movement of the sheets that are attracted toward the jaw cylinder K from the folding cylinder J.

In this way, the two sheets resulting from the fourth sheet having been overlaid on the external surface of the second sheet p2 on the circumferential surface of the folding cylinder J have their center gripped by the edge of the jaw plate K11 and the edge of the jaw plate K12 to be given a folding line at the gripped position. Then, the sheets overlaid together and given a folding line have their half following the folding line overlaid on their half on the leading side when on the circumferential surface of the folding cylinder J, whereby the two sheets gripped by the edge of the jaw plate K11 and the edge of the jaw plate K12 go sandwiched between the jaw cylinder K and the guide belt L, to be formed into a newspaper signature Pf1 printed with the first to eighth pages, like the newspaper signature Pf1 described above made up of the first sheet p1 and the third sheet.

The completed newspaper signature Pf1 made up of the second sheet p2 and the fourth sheet is discharged onto the conveyor N by the delivery fan M like the newspaper signature Pf1 made up of the first sheet p1 and the third sheet. With the above operation repeated, eight-page newspapers are produced successively.

Second Embodiment

Figure 6:
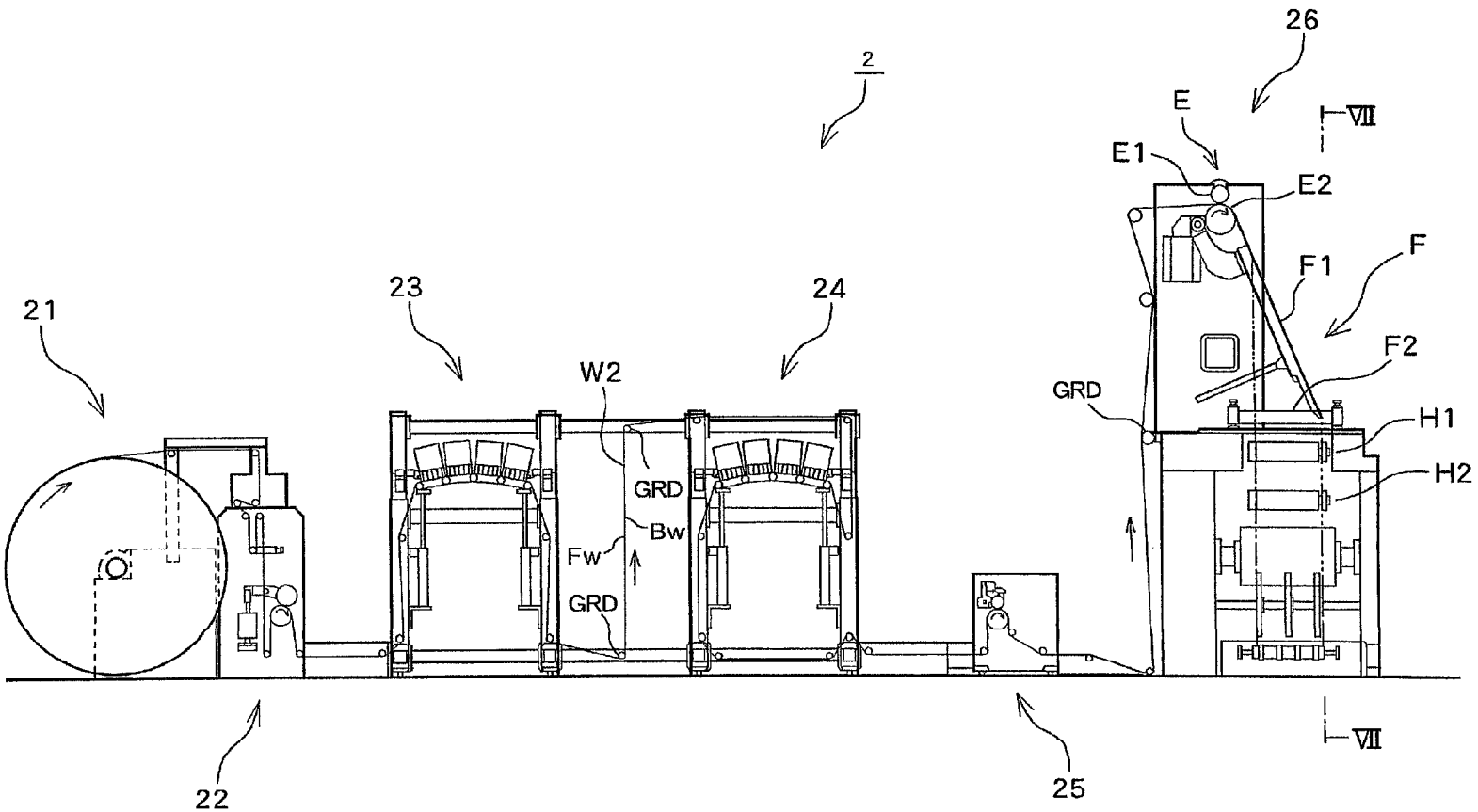
FIG. 6 is a front inner diagram showing a newspaper production apparatus according to a second embodiment.
Figure 7:
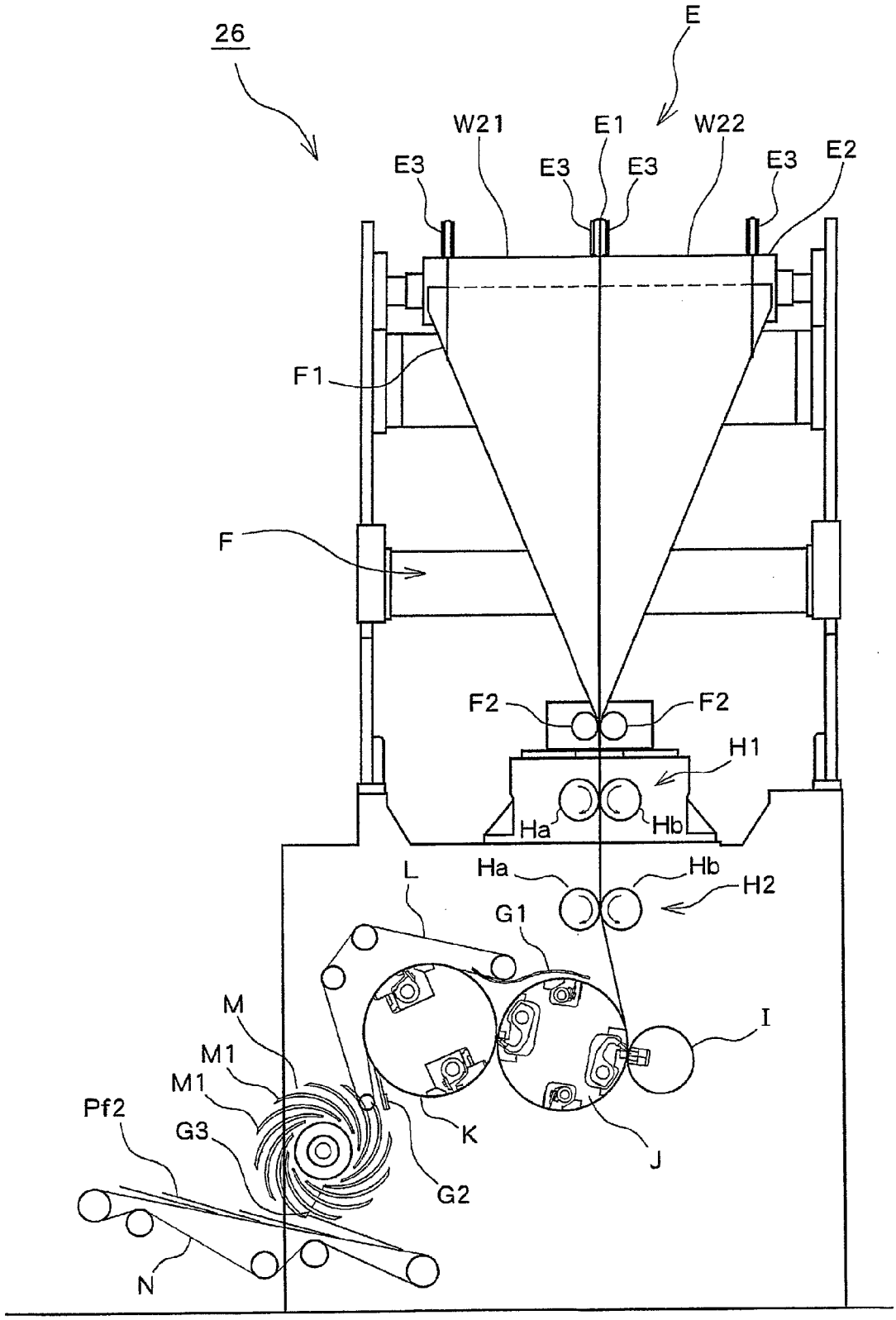
FIG. 7 is a sectional diagram of FIG. 6 taken at a position of VII-VII and seen with the sightline directed to the direction of arrows, and is an inner diagram of a folding unit.

FIG. 6 shows a front inner diagram of a newspaper production apparatus 2 as a second embodiment of the present invention. FIG. 7 is a sectional diagram of FIG. 6 taken at the position of VII-VII and seen with the sight line directed to the direction of arrows, and is an inner diagram of a folding unit 26. A drive source for rotating bodies which are rotatably driven and a belt which moves while being wound around a rotating body, etc. is not shown. Arrows indicate the rotating directions of the rotating bodies and the progressing direction of the belt and paper when printing is performed.

The newspaper production apparatus 2 includes, from the left-hand side of FIG. 6, a paper feeding unit 21, an in-feed unit 22, two ink jet printing units 23 and 24, an out-feed unit 25, and a folding unit 26, and a plurality of guide rollers GRD which are disposed at appropriate positions for guiding a continuous paper.

The functions of the paper feeding unit 21, the in-feed unit 22, the two ink jet printing units 23 and 24, the out-feed unit 25, and the guide rollers GRD are the same as those of the paper feeding unit 11, the in-feed unit 12, the two ink jet printing units 13 and 14, the out-feed unit 15, and the guide rollers GR of the newspaper production apparatus 1. The difference is that the width of a continuous paper W2 to be printed is double the width of the continuous paper W1 of the newspaper production apparatus 1, and the paper feeding unit 21, the in-feed unit 22, the two ink jet printing units 23 and 24, the out-feed unit 25 and the guide rollers GRD are adapted to the width of the continuous paper W2.

The folding unit 26 includes a slitter mechanism E, a former F as an overlaying mechanism, two pairs of nipping rollers H1 and H2, a cutting cylinder I, a folding cylinder J, a jaw cylinder K, a guide belt L, a delivery fan M, and a conveyor N.

The slitter mechanism E comprises a circular slitter knife E1 which is rotatably driven, a roller top of former E2 having double roles as a paper drawing roller and a guide roller for guiding the continuous paper W2 to the former F by being rotatably driven, and trolleys E3 that press the continuous paper W2 onto the circumferential surface of the roller top of former E2. The slitter knife E1 is positioned at the widthwise center of the continuous paper W2, and the roller top of former E2 has a groove, which is formed at a position corresponding to the blade edge (the outer circumferential edge) of the slitter knife E1 and which has a width slightly larger than the thickness of the slitter knife E1. By the blade edge of the slitter knife E1 biting into the groove of the roller top of former E2 by 1 to 3 millimeters, the continuous paper W2 wrapped around the roller top of former E2 is cut along its direction of continuation as it runs, to be separated into a continuous paper W21 and a continuous paper W22. To assist the roller top of former E2 in functioning as the paper drawing roller, the trolleys E3, which press the portions of the continuous paper W21 and continuous paper W22 near both side edges thereof onto the circumferential surface of the roller top of former E2, are provided.

The former F as an overlaying mechanism comprises a former board F1 having a shape of an upside-down triangle, and a pair of forming rollers F2 and F2 positioned to sandwich therebetween the vertex of the former board F1 while being aligned in an axial direction different from the roller top of former E2 by 90 degrees. The continuous paper W21 and the continuous paper W22 sent forth from the slitter mechanism E are conformed to the edges of the former board F1 so that their orientation parallel with the direction of continuation is changed by 90 degrees respectively, and overlaid together by the forming rollers F2 such that the back surfaces Bw of the continuous paper W21 and continuous paper W22 face and both edges of the continuous papers W21 and W22 meet.

Next, the continuous paper W21 and the continuous paper W22 overlaid together progress downward in an approximately vertical direction to be guided to the nipping rollers H1.

The two pairs of nipping rollers H1 and H2, the folding cylinder J, the jaw cylinder K, the guide belt L, the delivery fan M, and the conveyor N positioned downstream of the forming rollers F2 and F2 in the running direction of the continuous papers W21 and W22 are the same as those of the folding unit 16 included in the newspaper production apparatus 1 described above. Therefore, to skip the explanation of the configurations of these members, "continuous paper W1" should be read as "continuous paper W21 and continuous paper W22 overlaid together" and "newspaper signature Pf1" should be read as "newspaper signature Pf2" in the explanation given above.

Next a process of producing a newspaper including sixteen pages and written vertically with the use of the newspaper production apparatus 2 will be explained.

Figure 8:
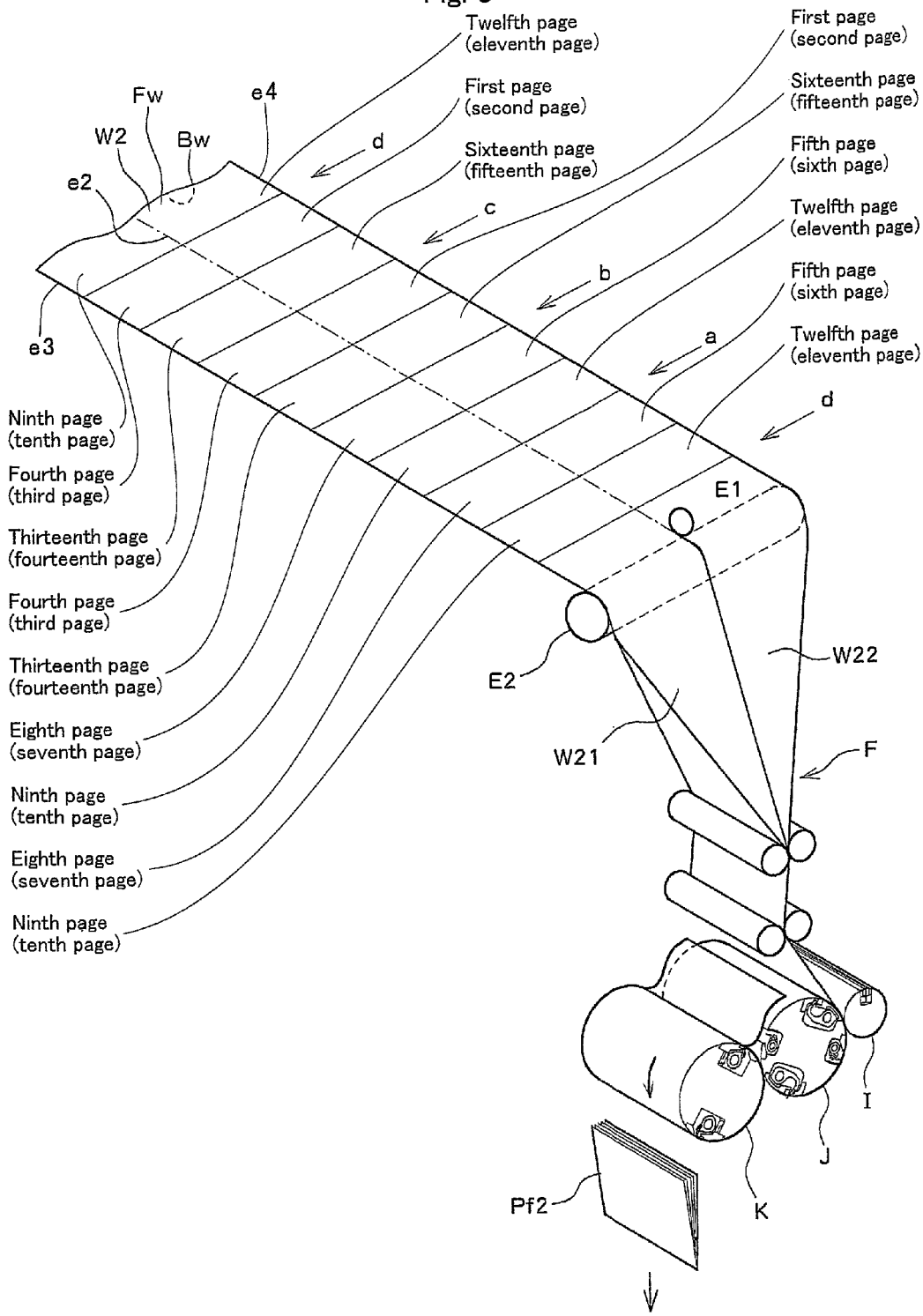
FIG. 8 is a perspective diagram exemplarily showing in a simplified form a path through which a printed continuous paper W becomes newspaper signatures.
Figure 9:
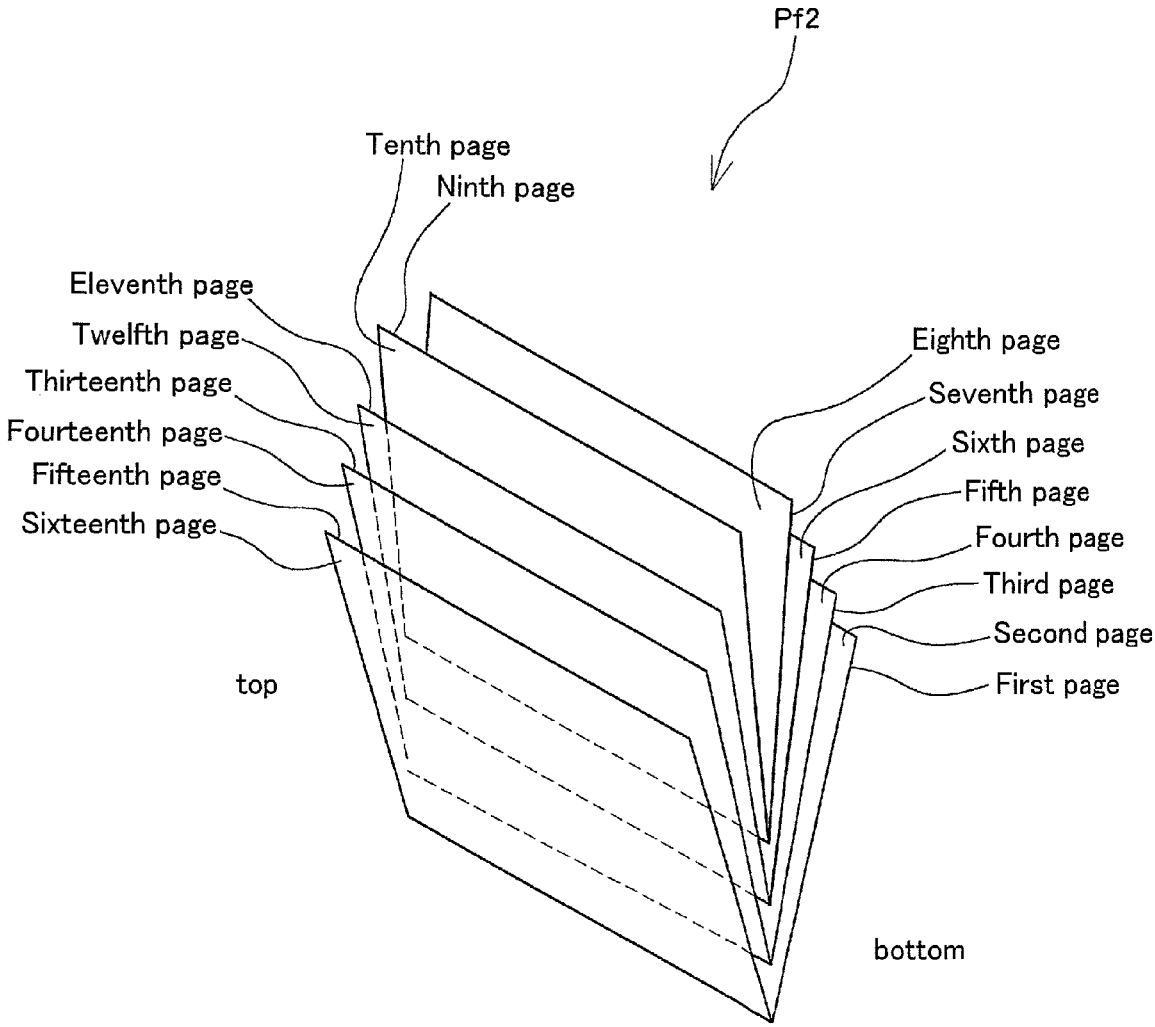
FIG. 9 is a perspective diagram showing a newspaper signature in an incompletely overlaid state, in order to show the page configuration of the newspaper signature in an easy-to-understand manner.

FIG. 8 is a perspective diagram exemplarily showing a path through which the continuous paper W2 having been printed becomes newspaper signatures Pf2. FIG. 9 is a perspective diagram showing a newspaper signature Pf2 of FIG. 8 in an incompletely overlaid state, in order to show the page configuration of the newspaper signature Pf2 in an easy-to-understand manner.

The width of the continuous paper W2 is the same as double the vertical length of a newspaper. According to the configuration of the newspaper production apparatus 2, the position of the continuous paper W2 to become an edge as cut by the slitter mechanism E, i.e., the widthwise center of the continuous paper W2 (the position indicated by a dashed line e2 in FIG. 8) is the bottom edge of the newspaper pages, and the widthwise both edges of the continuous paper W2 (the positions indicated by e3 and e4 in FIG. 8) are the top edge of the newspaper pages.

The continuous paper W2 passed from the paper feeding unit 21 into the first ink jet printing unit 23 through the in-feed unit 22 has its front surface Fw printed firstly with the content of a ninth page at the widthwise near side (the side to become the continuous paper W21 as cut by the slitter mechanism E) and the content of a twelfth page at the widthwise far side (the side to become the continuous paper W22 as cut by the slitter mechanism E), and then secondly with the content of an eighth page at the widthwise near side and the content of a fifth page at the widthwise far side.

The front surface Fw is printed thirdly with the content of the ninth page at the widthwise near side and the content of the twelfth page at the widthwise far side, and then fourthly with the content of the eighth page at the widthwise near side and the content of the fifth page at the widthwise far side again.

Subsequently, the front surface Fw is printed fifthly with the content of a thirteenth page at the widthwise near side and the content of a sixteenth page at the widthwise far side, and sixthly with the content of a fourth page at the widthwise near side and the content of a first page at the widthwise far side.

The front surface Fw is printed seventhly with the content of the thirteenth page at the widthwise near side and the content of the sixteenth page at the widthwise far side, and eighthly with the content of the fourth page at the widthwise near side and the content of the first page at the widthwise far side again.

That is, the contents are printed in the order of the ninth page, the eighth page, the ninth page, the eighth page, the thirteenth page, the fourth page, the thirteenth page, and the fourth page at the widthwise near side and in the order of the twelfth page, the fifth page, the twelfth page, the fifth page, the sixteenth page, the first page, the sixteenth page, and the first page at the widthwise far side repeatedly. The continuous paper W2 having had its front surface Fw printed in this way has its back surface Bw behind the content of the ninth page printed with the content of a tenth page and its back surface Bw behind the content of the twelfth page printed with the content of an eleventh page and has its back surface Bw behind the content of the eighth page printed with the content of a seventh page and its back surface Bw behind the content of the fifth page printed with the content of a sixth page repeatedly, and has its back surface Bw behind the content of the thirteenth page printed with the content of a fourteenth page and its back surface Bw behind the content of the sixteenth page printed with the content of a fifteenth page and has its back surface Bw behind the content of the fourth page printed with the content of a third page and its back surface Bw behind the content of the first page printed with the content of a second page repeatedly by the second ink jet printing unit 24. That is, on the back surface Bw, the contents are printed repeatedly in the order of the tenth page, the seventh page, the tenth page, the seventh page, the fourteenth page, the third page, the fourteenth page, and the third page at the widthwise near side, and in the order of the eleventh page, the sixth page, the eleventh page, the sixth page, the fifteenth page, the second page, the fifteenth page, and the second page at the widthwise far side (the pages parenthesized in FIG. 8) by performing positional matching with the contents printed on the front surface Fw.

The continuous paper W2 having had its front and back surfaces both printed is guided to the folding unit 26 through the out-feed unit 25.

The continuous paper W2 is drawn to above the former board F1 by the roller top of former E2 of the slitter mechanism E that also functions as a paper drawing roller and cut at its widthwise center by the slitter knife E1 to become the continuous paper W21 and the continuous paper W22. The continuous paper W21 and the continuous paper W22 are reoriented by 90 degrees along the inclined edges of the former board F1 and overlaid together by the forming rollers F2 and F2, and go to the nipping rollers H1. Rollers Ha and Hb of the nipping rollers H1 sandwich the widthwise both edges of the continuous paper W21 and continuous paper W22 overlaid together, i.e., the top and bottom margins of the page with an appropriate pressing force by their pressing portions, and send forth the continuous papers to the nipping rollers H2. Like the nipping rollers H1, the nipping rollers H2 also sandwich the widthwise both edges of the continuous paper W21 and continuous paper W22 overlaid together with an appropriate pressing force by their pressing portions, and send forth the continuous papers to between the folding cylinder J and the cutting cylinder I. Since the continuous paper W21 and the continuous paper W22 are sent forth sandwiched by the two pairs of rotatably driven rollers Ha and Hb, a change in the tension of the continuous papers due to the cutting performed between the following folding cylinder J and cutting cylinder I transmits no influence to the upstream side of the running path of the continuous paper W21 and the continuous paper W22. Further, since the rollers sandwich the margins of the page, the ink on the page does not transfer to the pressing portions of the rollers Ha and Hb or between the continuous paper W21 and the continuous paper W22, preventing the page from being stained.

The continuous paper W21 and the continuous paper W22 sent forth from the nipping rollers H2 downward enter between the folding cylinder J and the cutting cylinder I. Along with the rotation of both the cylinders, the pins J21 projecting from the surface of the folding cylinder J come to stick into the continuous paper W21 from the front surface Fw to the back surface Bw and the continuous paper W22 from the back surface Bw to the front surface Fw while the cheek wood I12 comes to sandwich the continuous paper W21 and the continuous paper W22 between itself and the cutting blade receiver J1, allowing the cutting blade I11 to eat into the cutting blade receiver J1 to cut the continuous paper W21 and the continuous paper W22.

By matching the printing timings of the ink jet printing units 22 and 23 and the rotation phases of the folding cylinder J and the cutting cylinder I, the positions to cut come between an eighth page printed on the front surface Fw of the continuous paper W21 and a ninth page printed after this (between a seventh page printed on the back surface Bw and a tenth page printed after this) and at the same time between a fifth page printed on the front surface Fw of the continuous paper W22 and a twelfth page printed after this (between a sixth page printed on the back surface Bw and an eleventh page printed after this (the position indicated by an arrow a in FIG. 8)), between an eighth page printed on the front surface Fw of the continuous paper W21 and a thirteenth page printed after this (between a seventh page printed on, the back surface Bw and a fourteenth page printed after this) and at the same time between a fifth page printed on the front surface Fw of the continuous paper W22 and a sixteenth page printed after this (between a sixth page printed on the back surface Bw and a fifteenth page printed after this (the position indicated by an arrow b in FIG. 8)), between a fourth page printed on the front surface Fw of the continuous paper W21 and a thirteenth page printed after this (between a third page printed on the back surface Bw and a fourteenth page printed after this) and at the same time between a first page printed on the front surface Fw of the continuous paper W22 and a sixteenth page printed after this (between a second page printed on the back surface Bw and a fifteenth page printed after this (the position indicated by an arrow c in FIG. 8)), and between a fourth page printed on the front surface Fw of the continuous paper W21 and a ninth page printed after this (between a third page printed on the back surface Bw and a tenth page printed after this) and at the same time between a first page printed on the front surface Fw of the continuous paper W22 and a twelfth page printed after this (between a second page printed on the back surface Bw and an eleventh page printed after this (the positions indicated by arrows d in FIG. 8)) repeatedly in this order.

Since the continuous paper W21 and the continuous paper W22 overlaid together are sandwiched between the cheek wood I12 and the cutting blade receiver J1, a wrong position will not be cut when the cutting blade I11 cuts the continuous paper W21 and the continuous paper W22 by eating into the cutting blade receiver J1.

The sheets resulting from the cutting are stuck by the pins J21 at their leading edge portion, and hence will be retained on the circumferential surface of the folding cylinder J until the pins J21 are retracted from the circumferential surface of the folding cylinder J and pulled out from the sheets.

In this way, a sheet resulting from the continuous paper W21 to have had its front surface Fw printed with the ninth and eighth pages and its back surface Bw printed with the tenth and seventh pages and a sheet resulting from the continuous paper W22 to have had its front surface Fw printed with the twelfth and fifth pages and its back surface Bw printed with the eleventh and sixth pages are generated firstly overlaid together with their back surfaces Bw facing each other, a sheet resulting from the continuous paper W21 to have had its front surface Fw printed with the ninth and eighth pages and its back surface Bw printed with the tenth and seventh pages and a sheet resulting from the continuous paper W22 to have had its front surface Fw printed with the twelfth and fifth pages and its back surface Bw printed with the eleventh and sixth pages are again generated secondly overlaid together with their back surfaces Bw facing each other, a sheet resulting from the continuous paper W21 to have had its front surface Fw printed with the thirteenth and fourth pages and its back surface Bw printed with the fourteenth and third pages and a sheet resulting from the continuous paper W22 to have had its front surface Fw printed with the sixteenth and first pages and its back surface Bw printed with the fifteenth and second pages are generated thirdly overlaid together with their back surfaces Bw facing each other, and a sheet resulting from the continuous paper W21 to have had its front surface Fw printed with the thirteenth and fourth pages and its back surface Bw printed with the fourteenth and third pages and a sheet resulting from the continuous paper W22 to have had its front surface Fw printed with the sixteenth and first pages and its back surface Bw printed with the fifteenth and second pages are again generated fourthly overlaid together with their back surfaces Bw facing each other, and this will be repeated.

When the first sheets (two sheets) cut out from the continuous paper W21 and the continuous paper W22 are retained taken up around a half of the circumference of the folding cylinder J as drawn with their leading edge stuck by the pins J21, the folding blade J31 retracted from the circumferential surface of the folding cylinder J under the first sheets (two sheets) does not project even upon reaching the position at which it faces the portion between the jaw plates K11 and K12 of the jaw cylinder K, and the pins J21 sticking into the leading edge of the first sheets (two sheets) are not retracted, either. That is, remaining drawn and retained by the pins J21, the first sheets (two sheets) go to the position where their leading edge overlaps the running path of the continuous paper W21 and the continuous paper W22 again.

The portions of the continuous paper W21 and continuous paper W22 to become the second sheets (two sheets) are also taken up around the circumferential surface of the folding cylinder J with their leading edge stuck by the pins J21.

The pins J21 drawing the first sheets (two sheets) by retaining the leading edge portion by sticking thereinto further stick into the continuous paper W21 and the continuous paper W22 sent forth from the nipping rollers H2 along with the rotation of the folding cylinder J, while the cutting blade device I1 cuts the continuous paper W21 and the continuous paper W22 sandwiched between itself and the cutting blade receiver J1 to separate the trailing edge of the second sheets (two sheets) from the leading edge of the portions of the continuous paper W21 and continuous paper W22 to become the third sheets. Then, the portions of the continuous paper W21 and continuous paper W22 to become the third sheets are also taken up around the folding cylinder J as overlaid on the first sheets (two sheets) and drawn by the pins J21.

In the meantime, the second sheets (two sheets) cut out from the continuous paper W21 and the continuous paper W22 go rotating together with the folding cylinder J, as drawn by the pins J21 and retained taken up around a half of the circumference of the folding cylinder J. Then, when the folding blade J31 retracted from the circumferential surface of the folding cylinder J under the second sheets (two sheets) reaches the position where it faces the portion between the jaw plates K11 and K12 of the jaw cylinder K, the folding blade J31 does not project, and the pins J21 sticking into the leading edge of the second sheets (two sheets) are not retracted, either. That is, remaining drawn by the pins J21, the second sheets (two sheets) also go to the position where their leading edge portion overlaps the running path of the continuous paper W21 and the continuous paper W22 again.

The pins J21 drawing the second sheets (two sheets) by retaining the leading edge portion by sticking thereinto further stick into the continuous paper W21 and the continuous paper W22 sent forth from the nipping rollers H2 along with the rotation of the folding cylinder J, while the cutting blade device I1 cuts the continuous paper W21 and the continuous paper W22 sandwiched between itself and the cutting blade receiver J1 to separate the trailing edge of the third sheets (two sheets) from the leading edge of the portions of the continuous paper W21 and continuous paper W22 to become the fourth sheets. Then, the portions of the continuous paper W21 and continuous paper W22 to become the fourth sheets are also taken up around the folding cylinder J as overlaid on the external surface of the second sheets (two sheets) and drawn by the pins J21.

Then, immediately before the folding blade J31 retracted from the circumferential surface of the folding cylinder J under the first sheets (two sheets) and the third sheets (two sheets) overlaid together reaches the position where it faces the portion between the jaw plates K11 and K12 of the jaw cylinder K, the folding blade device J3 begins projecting the folding blade J31 and at approximately the same time as this, the pin device J2 sticking into the leading edge of the first sheets (two sheets) and third sheets (two sheets) retracts the pins J21.

Immediately after the above actions, the folding blade J31 comes to face the portion between the jaw plates K11 and K12 of the jaw cylinder K and inserts the first sheets (two sheets) and the third sheets (two sheets) into between the jaw plates K11 and K12. Immediately after the insertion, the jaw device K1 swings the jaw plate K12 about the swing shaft K120 to grip the inserted first sheets (two sheets) and third sheets (two sheets) by the edge of the jaw plate K12 and the edge of the jaw plate K11, thereby attracting the leading half of the first sheets (two sheets) and third sheets (two sheets) toward the jaw cylinder K from the folding cylinder J, and having the trailing half of the first sheets (two sheets) and third sheets (two sheets) taken up around the jaw cylinder K.

After inserting the first sheets (two sheets) and the third sheets (two sheets) into between the jaw plates K11 and K12, the folding blade J31 is retracted into the folding cylinder J so as not to hinder the movement of the sheets that are attracted toward the jaw cylinder K from the folding cylinder J.

In this way, the four overlaid sheets resulting from the third sheets (two sheets) having been overlaid on the first sheets (two sheets) have their center gripped by the edge of the jaw plate K11 and the edge of the jaw plate K12 to be given a folding line at the gripped position. Then, the sheets overlaid together and given a folding line have their half following the folding line overlaid on their half on the leading side when on the circumferential surface of the folding cylinder J, whereby the four sheets gripped by the edge of the jaw plate K11 and the edge of the jaw plate K12 go sandwiched between the jaw cylinder K and the guide belt L, to be formed into a newspaper signature Pf2 printed with the first to sixteenth pages. (See FIG. 9)

The newspaper signature Pf2 is carried to above the delivery fan M by the jaw cylinder K and the guide belt L. Before the gripped position of the newspaper signature Pf2 reaches the paper guide G2, the jaw device K1 swings the jaw plate K12 in a direction to separate its edge from the edge of the jaw plate K11 to release the newspaper signature Pf2 from the jaw plate K11 and the jaw plate K12 so that the newspaper signature Pf2 is thrown into between a blade M1 and a blade M1 of the delivery fan M by the paper guide G2 and a portion of the guide belt L that extends along the paper guide G2.

The newspaper signature Pf2 thrown into and received between a blade M1 and a blade M1 is discharged from between the blade M1 and the blade M1 onto the conveyor N, when the position in the delivery fan M in which it is received comes to the bottom as the delivery fan M rotates.

Meanwhile, the portions of the continuous paper W21 and continuous paper W22 to become the fourth sheets are also taken up around the folding cylinder J as overlaid on the external surface of the second sheets (two sheets) and drawn by the pins J21, while the cutting blade device I1 cuts the continuous paper W21 and the continuous paper W22 sandwiched between itself and the cutting blade receiver J1 to separate the trailing edge of the fourth sheets (two sheets) from the continuous paper W21 and the continuous paper W22. Then, immediately before the folding blade J31 retracted from the circumferential surface of the folding cylinder J under the second sheets (two sheets) and the fourth sheets (two sheets) overlaid together reaches the position where it faces the portion between the jaw plates K11 and K12 of the jaw cylinder K, the folding blade device J3 begins projecting the folding blade J31, and at approximately the same time as this, the pin device J2 sticking into the leading edge of the second sheets (two sheets) and fourth sheets (two sheets) retracts the pins J21.

Immediately after the above actions, the folding blade J31 comes to face the portion between the jaw plates K11 and K12 of the jaw cylinder K and inserts the second sheets (two sheets) and the fourth sheets (two sheets) into between the jaw plates K11 and K12. Immediately after the insertion, the jaw device K1 swings the jaw plate K12 about the swing shaft K120 to grip the inserted second sheets (two sheets) and fourth sheets (two sheets) by the edge of the jaw plate K12 and the edge of the jaw plate K11, thereby attracting the leading half of the second sheets (two sheets) and fourth sheets (two sheets) toward the jaw cylinder K from the folding cylinder J and having the trailing half of the second sheets (two sheets) and fourth sheets (two sheets) taken up around the jaw cylinder K.

After inserting the second sheets (two sheets) and the fourth sheets (two sheets) into between the jaw plates K11 and K12, the folding blade J31 is retracted into the folding cylinder J so as not to hinder the movement of the sheets that are attracted toward the jaw cylinder K from the folding cylinder J.

In this way, the four overlaid sheets resulting from the fourth sheets (two sheets) having been overlaid on the second sheets (two sheets) on the circumferential surface of the folding cylinder J have their center gripped by the edge of the jaw plate K11 and the edge of the jaw plate K12 to be given a folding line at the gripped position. Then, the sheets overlaid together and given a folding line have their half following the folding line overlaid on their half on the leading side when on the circumferential surface of the folding cylinder J, whereby the four sheets gripped by the edge of the jaw plate K11 and the edge of the jaw plate K12 go sandwiched between the jaw cylinder K and the guide belt L, to be formed into a newspaper signature Pf2 printed with the first to sixteenth pages, like the newspaper signature Pf2 described above made up of the first sheets (two sheets) and the third sheets (two sheets).

The completed newspaper signature Pf2 made up of the second sheets (two sheets) and the fourth sheets (two sheets) is discharged onto the conveyor N by the delivery fan M like the newspaper signature Pf2 made up of the first sheets (two sheets) and the third sheets (two sheets). With the above operation repeated, sixteen-page newspapers are produced successively.

Figure 10:
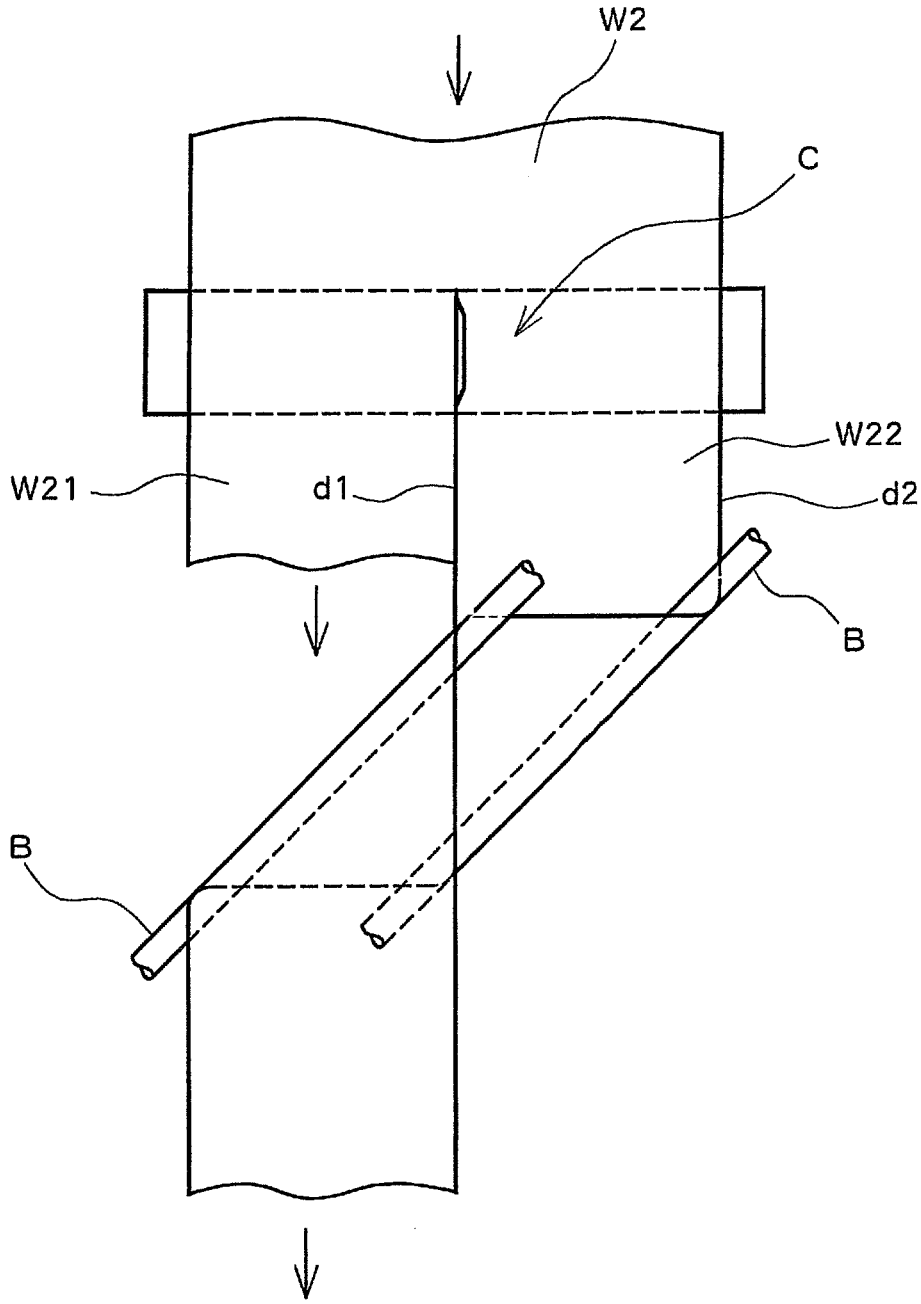
FIG. 10 is a plan diagram showing a slitter mechanism and an overlaying mechanism comprising two angle bars.

In the newspaper production apparatus 2 shown in FIG. 6, the slitter mechanism and the former as the overlaying mechanism are provided in the folding unit, but this is not limiting. A slitter mechanism C and an overlaying mechanism comprising two angle bars B and B, which are shown in the plan diagram of FIG. 10, may be provided in the running path of the continuous paper after being printed, and one continuous paper W2 may be cut in its direction of continuation to be made into a continuous paper W21 and a continuous paper W22, which may be guided to the folding unit overlaid together with their both edges meeting (the arrows in FIG. 10 indicate the running direction of the continuous paper). In the configuration of FIG. 10, the edge indicated by a sign d1 in FIG. 10 is the top edge of the newspaper pages printed on the continuous paper W21, and the edge indicated by a sign d2 is the top edge of the newspaper pages printed on the continuous paper W22.

Though preferred embodiments of the present invention have been explained, the technical scope of the present invention is not limited to the scope of description of the embodiments described above. Various changes or improvements can be made to the embodiments described above.

For example, both the first and second embodiments have explained a process of producing a newspaper that is made up of a number of sheets double the number of continuous papers, by performing in the newspaper production a so-called collect run which produces a signature by retaining a sheet on the circumferential surface of the rotating folding cylinder J and overlaying another sheet on the retained sheet, by performing an operation of projecting the folding blade J31 of each folding blade device J3 and at approximately the same timing retracting the pins J21 of the pin device J2 that is preceding the folding blade J31 by about 90 degrees, once in two turns of the folding cylinder J when the folding blade J31 reaches the position where it faces the portion between the jaw plates K11 and K12 of the jaw cylinder K. However, since the ink jet printing unit can print any arbitrary plural number of kinds of page contents in an arbitrary order, it is possible to produce a newspaper that is made up of a number of sheets X times as large as the number of continuous papers, by winding and retaining sheets and overlaying them on the circumferential surface of the folding cylinder J, by performing the above operation of projecting the folding blade J31 of each folding blade device J3 and retracting the pins J21 of the pin device J2, once in X turns of the folding cylinder J.

Since no newspaper signature is thrown into between a blade and another blade of the rotating delivery fan for so long as the sheets are retained wound around the circumferential surface of the folding cylinder and overlaid together, newspaper signatures will fall into an unequally-spaced arrangement on the conveyor. In order to make newspaper signatures fall into an equally-spaced arrangement on the conveyor, the conveyor may be driven intermittently or at an inconstant speed in synchronization with the newspaper signatures to be discharged from the delivery fan. Needless to say, it is not a problem to process newspaper signatures fallen into an unequally-spaced arrangement on the conveyor by an after-treatment device in this arrangement.

The folding unit 16 and the folding unit 26 of the first and second embodiments are a so-called jaw folding mechanism in which the jaw device K1 of the jaw cylinder K grips sheets, which are thus folded at the gripped position. However, they may be a folding unit having a so-called blade folding mechanism in which a pair of folding rollers are provided on a bottom portion of the folding cylinder, and a folding blade to project from the folding cylinder thrusts a sheet into between the folding rollers to form a folding line.

The folding cylinder J and the jaw cylinder K of the folding unit 16 and folding unit 26 are a so-called two-times cylinder of which circumferential length is twice as large as the cutting length by which the continuous paper is cut in parallel with its widthwise direction. However, their circumferential length may be three or more times as large as the cutting length.

In order to perform a collect run in a printing by a rotary press, it has been necessary that the circumferential length of the folding cylinder be an odd-number multiple of the cutting length, generally three times or five times as large as the cutting length. This is because the rotary press performs printing with a plate cylinder that has a circumferential length twice as large as the cutting length and that is fitted with two press plates for printing different pages, and hence the different pages that should be overlaid together are printed alternately, adjoining each other in the running direction of the continuous paper. Therefore, in order to make the two kinds of different pages be overlaid on a folding cylinder by a collect run, the folding cylinder needs to be, for example, a three-times folding cylinder, which enables the first sheet to be overlaid with the fourth sheet that is printed with the page of the different kind from that on the first sheet. However, since an ink jet printing unit can print an arbitrary plural number of kinds of pages in an arbitrary order, the circumferential length of the folding cylinder is not limited to an odd-number multiple of the cutting length, which enables the folding unit to be downsized.

Third Embodiment

Figure 11:
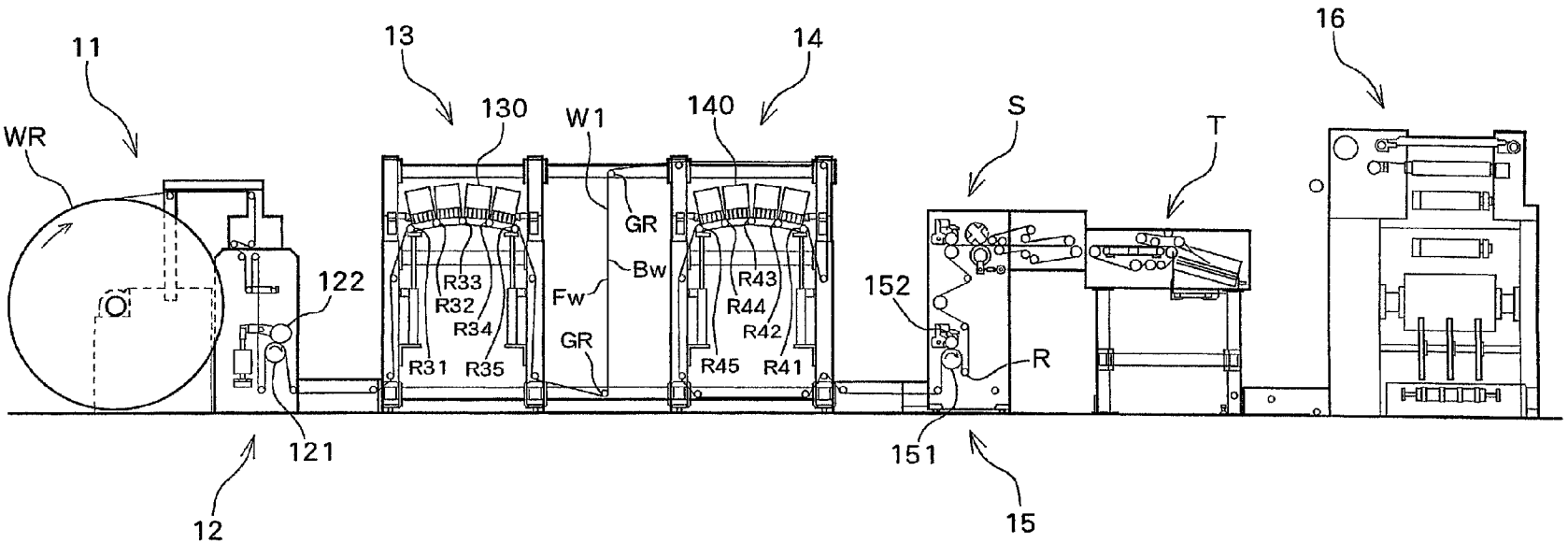
FIG. 11 is a front inner diagram showing a newspaper production apparatus according to a third embodiment.

FIG. 11 shows a newspaper production apparatus 3 according to a third embodiment. The newspaper production apparatus 3 additionally includes a sheet producing device S and a sheet accumulating device T, which, when considered in the newspaper production apparatus 1, are provided between above the out-feed unit 15 and the folding unit 16, and has a paper path that guides the continuous paper W1 to the sheet producing device S from a guide roller R provided after the out-feed roller 151. It is possible to select which of the path to the folding unit 16 and the path to the sheet producing device S the printed continuous paper W1 takes. By going to the sheet producing device S, the continuous paper W1 can be cut into sheets, which are to be accumulated on the sheet accumulating device T. Since various devices have become known as the sheet producing device and the sheet accumulating device, explanation about the sheet producing device S and the sheet accumulating device T will be skipped here. The newspaper production apparatus 3 shown in FIG. 11 can produce a newspaper signature by the folding unit 16, and can also produce a sheet-shaped print product having a predetermined cutting length by guiding the continuous paper W1 to the sheet producing device S.

It is clear from the descriptions in the claims that embodiments including such changes or improvements can be included in the technical scope of the present invention.

What is claimed is:

1. A newspaper production apparatus, comprising:

a paper feeding unit which feeds a continuous paper;

an ink jet printing unit;

a folding unit which cuts and folds the continuous paper having been printed; and a controller which controls the folding unit, wherein the folding unit is a rotary folding unit provided with a folding cylinder including: a retaining mechanism which is capable of retaining a sheet on an outer circumferential surface of the folding cylinder and is capable of releasing the retained sheet at an appropriate timing by control of the controller; and a folding blade mechanism which projects the retained sheet radially outward at an appropriate timing by control of the controller, and the rotary folding unit is controlled by the controller to, by performing an operation of releasing the retained sheet by the retaining mechanism and an operation of projecting the retained sheet by the folding blade mechanism once in an arbitrary plural number of turns of the folding cylinder, be capable of collect run by which sheets retained by the retaining mechanism are folded at each arbitrary plural number of turns of the folding cylinder.

2. The newspaper production apparatus according to claim 1, wherein a slitter mechanism and an overlaying mechanism are provided downstream of the ink jet printing unit, wherein the slitter mechanism cuts the continuous paper along its direction of continuation, and the overlaying mechanism overlays the cut continuous papers.

3. The newspaper production apparatus according to claim 2, wherein the slitter mechanism and the overlaying mechanism are provided on the folding unit.

* * * * *